US006767284B1

(12) United States Patent
Koza

(10) Patent No.: US 6,767,284 B1
(45) Date of Patent: Jul. 27, 2004

(54) SKILL GAMES

(75) Inventor: John R. Koza, 25372 La Rena La., Los Altos Hills, CA (US) 94022

(73) Assignee: John R. Koza, Los Altos, CA (US)

( * ) Notice: Subject to any disclaimer, the term of this patent is extended or adjusted under 35 U.S.C. 154(b) by 0 days.

(21) Appl. No.: 09/524,857

(22) Filed: Mar. 14, 2000

(51) Int. Cl.[7] ..... A63F 9/24
(52) U.S. Cl. ..... 463/29; 463/42
(58) Field of Search ..... 463/1, 6, 7, 9, 463/10–16, 25, 23, 30, 36, 29, 40–42; 273/292, 293, 138.1, 138.2, 139, 429–432, 459–461, 440, 236, 237, 275; 379/93.13; 380/23, 25; 235/375, 380, 382; 700/91–93; 713/200, 201; 709/225, 229

(56) References Cited

U.S. PATENT DOCUMENTS

| | | | | |
|---|---|---|---|---|
| 4,586,707 | A | | 5/1986 | McNeight et al. |
| 4,593,904 | A | | 6/1986 | Graves |
| 4,666,160 | A | | 5/1987 | Hamilton |
| 4,669,730 | A | | 6/1987 | Small |
| 4,756,532 | A | | 7/1988 | Kamille |
| 4,845,739 | A | * | 7/1989 | Katz |
| 4,926,327 | A | | 5/1990 | Sidley |
| 4,964,642 | A | | 10/1990 | Kamille |
| 5,038,022 | A | | 8/1991 | Lucero |
| 5,083,271 | A | | 1/1992 | Thacher et al. |
| 5,092,598 | A | | 3/1992 | Kamille |
| 5,094,458 | A | | 3/1992 | Kamille |
| 5,114,155 | A | | 5/1992 | Tillery et al. |
| 5,420,830 | A | | 5/1995 | Camaratta, Jr. et al. |
| 5,429,361 | A | | 7/1995 | Raven et al. |
| 5,454,570 | A | | 10/1995 | Karal |
| 5,513,117 | A | | 4/1996 | Small |
| 5,518,249 | A | | 5/1996 | Sines et al. |
| 5,544,892 | A | | 8/1996 | Breeding |
| 5,546,523 | A | | 8/1996 | Gatto |

(List continued on next page.)

FOREIGN PATENT DOCUMENTS

| | | |
|---|---|---|
| WO | WO 94/27921 | 5/1994 |
| WO | WO 97/19537 | 1/1996 |
| WO | WO 98/00210 | 6/1997 |

*Primary Examiner*—Mark Sager
(74) *Attorney, Agent, or Firm*—Blakely, Sokoloff, Taylor & Zafman LLP

(57) ABSTRACT

Skill games are described that are implemented using network communications. The subject matter of the present invention concerns games of skill that are legal, under current law, in most states of the United States and in many jurisdictions of other countries and the game includes a mechanism for determining if a player is eligible.

86 Claims, 25 Drawing Sheets

U.S. PATENT DOCUMENTS 5,549,300 A 8/1996 Sardarian
5,566,946 A 10/1996 Parker
5,593,349 A 1/1997 Miguel et al.
5,643,088 A 7/1997 Vaughn et al.
5,649,705 A 7/1997 String
5,660,391 A 8/1997 Klasee
5,660,392 A 8/1997 Hansen
5,667,217 A 9/1997 Kelly et al.
5,676,371 A 10/1997 Kelly et al.
5,697,611 A 12/1997 Kelly et al.
5,697,844 A * 12/1997 Von Kohorn
5,700,007 A 12/1997 Kelly et al.
5,704,612 A 1/1998 Kelly et al.
5,733,193 A 3/1998 Allard et al.
5,743,523 A 4/1998 Kelly et al.
5,743,532 A 4/1998 Lafferty
5,755,621 A 5/1998 Marks et al.
5,768,382 A 6/1998 Schneier et al.
5,769,424 A 6/1998 Kelly et al.
5,779,549 A * 7/1998 Walker
5,803,451 A 9/1998 Kelly et al.
5,816,918 A 10/1998 Kelly et al.
5,836,586 A 11/1998 Marks et al.
5,855,514 A 1/1999 Kamille
5,860,648 A 1/1999 Petermeier et al.
5,882,258 A 3/1999 Kelly et al.
5,888,115 A 3/1999 Shoemaker, Jr. et al.
5,902,983 A 5/1999 Crevelt et al.
5,931,467 A 8/1999 Kamille
5,944,316 A 8/1999 Hernandez
5,967,514 A 10/1999 Kelly et al.
5,970,143 A 10/1999 Schneier et al.
5,996,997 A 12/1999 Kamille
6,007,426 A 12/1999 Kelly et al.
6,012,722 A 1/2000 Petermeier et al.
6,015,344 A 1/2000 Kelly et al.
6,019,374 A 2/2000 Breeding
6,024,640 A 2/2000 Walker et al.
6,048,271 A 4/2000 Barcelou
6,104,815 A * 8/2000 Alcorn
6,174,237 B1 1/2001 Stephenson

* cited by examiner

The Presidents Game
[300] Game Number 123456

[310] Hints:
1. President who served non-consecutive terms
2. President who was elected to Senate after being president
3. President who was in railway accident on his way to his inauguration in which his son was killed
4. President elected by the House of Representatives after failing to receive a majority of the electoral votes
5. First president to travel outside the United states while still in office
6. First president to be photographed while in office

[320]
☐ George Washington
☐ John Adams
☐ Thomas Jefferson
☐ James Madison
☐ James Monroe
☐ John Quincy Adams
☐ Andrew Jackson
☐ Martin Van Buren
☐ William Henry Harrison
☐ John Tyler
☐ James K. Polk
☐ Zachery Taylor
☐ Millard Fillmore
☐ Franklin Pierce
☐ James Buchanan
☐ Abraham Lincoln
☐ Andrew Johnson
☐ Ulysses S. Grant
☐ Ruthford Hayes
☐ James A. Garfield
☐ Chester A. Arthur
☐ Grover Cleveland
☐ Benjamin Harrison
☐ William McKinley
☐ Theodore Roosevelt
☐ William H. Taft

FIG. 3A

- ☐ Woodrow Wilson
- ☐ Warren G. Harding
- ☐ Calvin Coolidge
- ☐ Herbert Hoover
- ☐ Franklin Roosevelt
- ☐ Harry S. Truman
- ☐ Dwight D. Eisenhower
- ☐ John F. Kennedy
- ☐ Lyndon Johnson
- ☐ Richard Nixon
- ☐ Gerald Ford
- ☐ Jimmy Carter
- ☐ Ronald Reagan
- ☐ George Bush
- ☐ William Clinton

[330]

Click here to submit your answers

[340] Ending time: 18:15:00 PST

[350]

Click here for official time

[360]

Click here for rules

FIG. 3B

The History Game
[400] Game Number 1234567

[410] Hints:
1. Date of the Battle of Waterloo
2. Date of completion of the transcontinental railroad in Canada
3. Month when the state from which the greatest number of presidents have been elected was admitted to the United States

[420]

| Query 1 | Query 2 | Query 3 |
|---|---|---|
| ☐ January | ☐ January | ☐ January |
| ☐ February | ☐ February | ☐ February |
| ☐ March | ☐ March | ☐ March |
| ☐ April | ☐ April | ☐ April |
| ☐ May | ☐ May | ☐ May |
| ☐ June | ☐ June | ☐ June |
| ☐ July | ☐ July | ☐ July |
| ☐ August | ☐ August | ☐ August |
| ☐ September | ☐ September | ☐ September |
| ☐ October | ☐ October | ☐ October |
| ☐ November | ☐ November | ☐ November |
| ☐ December | ☐ December | ☐ December |

Click here to submit your answers

Ending time: 18:15:00 PST

Click here for official time

Click here for rules

FIG. 4

The Decades Game
[500] Game Number 123458

[510] Questions:
1. In what decade was the first non-stop transcontinental airplane flight made in Australia?
2. In what decade was the Luisitania sunk?

- ☐ 1900 - 1909
- ☐ 1910 - 1919
- ☐ 1920 - 1929
- ☐ 1930 - 1939
- ☐ 1940 - 1949
- ☐ 1950 - 1959
- ☐ 1960 - 1969
- ☐ 1970 - 1979
- ☐ 1980 - 1989
- ☐ 1990 - 1999

Click here to submit your answers

Ending time: 18:15:00 PST

Click here for official time

Click here for rules

FIG. 5

Crossword Geography Game
[600]Game Number 123459

[610]Hints:
2-Across - 22nd state to be admitted to the Union
3-Across - Capital of Bulgaria
7-Across - Northern California city
2-Down - U.S. state purchased from another country
3-Down - Major European city and a county seat in Texas
5-Down - Leading agricultural U.S. state

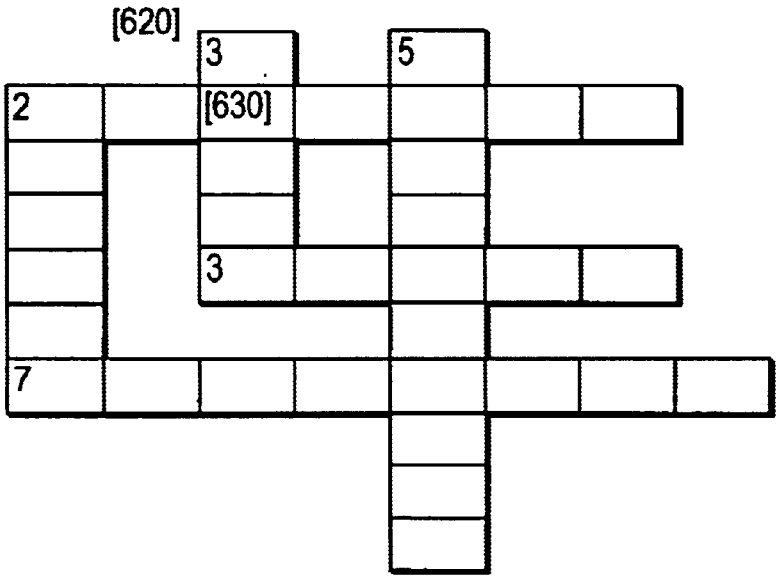

Click here to submit your answers

Ending time: 18:15:00 PST

Click here for official time

Click here for rules

FIG. 6

Solution to Game Number 123459

The Letter Reallocation Game (using each letter of the Starting Word exactly once)

[800] Game Word: 123460

[810] Starting Word: STEAK

[820]

| | | | | |
|---|---|---|---|---|
| | | | | |
| | | | | |
| | | | | |
| | | | | |
| | | | | |
| | | | | |
| | | | | |

Click here to submit your answers

Ending time: 18:15:00 PST

Click here for official time

Click here for rules

FIG. 8

The Letter Reallocation Game (with each letter of the Starting Word usable zero, one, or more times)

[900] Game Number: 123461

[910] Starting Word: ARITHMETIC

[920]

_____

_____

_____

_____

_____

_____

_____

Click here to submit your answers

Ending time: 18:15:00 PST

Click here for official time

Click here for rules

FIG. 9

The Days of the Week Game

[1000] Game Number: 123462

[1010] Hints:

1. Day when Charles Lindburgh arrived in Paris after his transatlantic solo flight
2. Day when Japanese attacked Pearl Harbor

- ☐ Monday
- ☐ Tuesday
- ☐ Wednesday
- ☐ Thursday
- ☐ Friday
- ☐ Saturday
- ☐ Sunday Click here to submit your answers Ending time: 18:15:00 PST Click here for official time Click here for rules

FIG. 10

Illustrative Communication Path on the Internet from Los Altos, California to San Diego, California Names of Servers in one Illustrative Communication Path on the Internet between Los Altos, California and San Diego, California First Name Game

[1300] Game Number: 123463

[1310] Hints:
1. Lead actor in the movie Stagecoach
2. King of England who gave up his throne for woman he loved

[1320]

- ☐ Adam
- ☐ Charles
- ☐ Donald
- ☐ Edward
- ☐ Frank
- ☐ George
- ☐ Henry
- ☐ John
- ☐ Louis
- ☐ Michael
- ☐ Paul
- ☐ Richard

[1330]

Click here to submit your answers

Ending time: 18:15:00 PST

Click here for official time

Click here for rules

FIG. 13

The Traveling Salesman Game

[1400] Game Number: 123464

[1410]

[1415]

Click here to delete last segment

[1418]

Click here to start anew

[1420]

Click here to submit your answer

Ending time: 18:15:00 PST

Click here for official time

Click here for rules

The Jigsaw Game

[1600] Game Number: 123465

[1610]

[1620]

Click here to submit your answer

Ending time: 18:15:00 PST

Click here for official time

Click here for rules

The Hamiltonian Path Game

[1800] Game Number: 123465

[1810]

[1815]

Click here to delete last segment

[1818]

Click here to start anew

[1820]

Click here to submit your answer

Ending time: 18:15:00 PST

Click here for official time

Click here for rules

The Knapsack Game

[2200] Game Number: 123467

[2206]
Maximum allowed weight: 10 pounds
[2208]
Total weight so far: 0 pounds
[2209]
Total value so far: $0

[2218]

Click here to start anew

[2220]

Submit

Ending time: 18:15:00 PST

Click here for official time

Click here for rules

MENU [2300]

| 2310 | 2320 | 2330 | 2340 | 2350 | 2360 | 2370 | 2380 | 2390 | 2395 |
|---|---|---|---|---|---|---|---|---|---|
| ☐ 2311 | First Name Game | $1 | $10 | Rules [2351] | Sample [2361] | 5 min | 1,234 winners [2381] | 1 waiting | 2 needed |
| ☐ 2312 | Crossword Geography | $1 | $5 | Rules | Sample | 5 min | 3,156 winners | 0 waiting [2392] | 2 needed |
| ☐ 2313 | Bin Packing | $1 | $20 | Rules | Sample | 10 min | 2,889 winners | 0 waiting [2393] | 2 needed |
| ☐ 2314 | Traveling Salesman | $1 | $25 | Rules | Sample | 10 min [2374] | 1,759 winners | 1 waiting [2394] | 2 needed [2399] |

FIG. 23

MENU [2400]

[2401]

| | | | | | | | | | |
|---|---|---|---|---|---|---|---|---|---|
| ☐ 2411 | Decades Game 2421 | $1 2431 | $2 2441 | Rules | Sample | 5 min 2471 | 2,344 winners 2479 | 1 waiting 2481 | 3 needed 2491 |
| ☐ 2412 | Presidents Game 2422 | $2 2432 | $5 2442 | Rules | Sample | 5 min | 3,156 winners | 1 waiting 2482 | 3 needed 2492 |
| ☐ 2413 | Knapsack Game 2423 | $1 2433 | $2 2443 | Rules | Sample | 5 min | 2,889 winners | 1 waiting 2483 | 3 needed 2493 |
| ☐ 2414 | Hamiltonian Path 2424 | $2 2434 | $5 2444 | Rules | Sample | 5 min | 1,759 winners | 1 waiting 2484 | 3 needed 2494 |

[2405]

| | | | | | | | | |
|---|---|---|---|---|---|---|---|---|
| ☐ 2415 | Months Game 2425 | $1 2435 | $10 2445 | Rules | Sample | 10 min 2475 | 1,045 winners | Noon Monday 2485 |
| ☐ 2416 | Traveling Salesman Game 2426 | $2 2436 | $10 2446 | Rules | Sample | 10 min | 1,479 winners | Noon Tuesday |

[2407]

| | | | | | | | | |
|---|---|---|---|---|---|---|---|---|
| ☐ 2417 | States Game 2427 | $1 2437 | $25 2447 | Rules | Sample | 24 hours 2477 | 1,548 winners | Noon Friday |

FIG. 24

SKILL GAMES

FIELD OF THE INVENTION

The present invention relates to the field of skill games; more particularly, the present invention relates to skill games that are implemented using network communications.

BACKGROUND OF THE INVENTION

Various forms of games are well known in the prior art. It is often useful to categorize such games on the basis of whether they possess the attributes of prize, chance, and consideration. First, a game may be categorized on the basis of whether it is played in order to win something of value (a prize) or whether it is played for only amusement purposes. Second, a game may also be categorized on the basis of whether participation is free or whether some valuable consideration is required in order to participate in the game. Third, a game may be further categorized on the basis of whether it involves chance or skill.

Games of chance include bingo, casino games (e.g., roulette), promotional giveaway games of chance operated by commercial entities, and games such as lotto games and the rub-off instant lottery game that are operated by most state governments in the United States and various national, provincial, state, and municipal lotteries in other countries.

Games of skill include crossword puzzles, games involving answering questions based on knowledge about specific fields (e.g., history and geography), and games of skill involving more than one player (e.g., checkers or chess).

Subject to certain limited and specific exceptions, it is generally illegal to operate a game involving prize, chance, and consideration in most states of the United States and in most jurisdictions of most other countries. A game involving the attributes of prize, chance, and consideration is often called a "lottery" under the laws of many states of the United States and under the laws of many other countries. Section 319 of chapter 9 of the California code is typical of the laws of many states of the United States and under the laws of many other countries in the way that it defines a lottery as follows:

> A lottery is any scheme for the disposal or distribution of property by chance, among persons who have paid or promised to pay any valuable consideration for the chance of obtaining such property or a portion of it, or for any share of any interest in such property, upon any agreement, understanding, or expectation that it is to be distributed or disposed of by lot or chance, whether called a lottery, raffle, or gift-enterprise, or by whatever name the same may be known.

With certain limited exceptions (described below), lotteries are generally deemed to be illegal by the laws of most states of the United States and under the laws of most other countries. For example, subject to certain limited and specific exceptions provided by other sections of California law, lotteries as defined in section 319 are illegal in California.

The exceptions to the laws making most lotteries illegal vary considerably by jurisdiction. For example, bingo games clearly involve prize, chance, and consideration (that is, the player pays money in order to buy a chance to win a prize). Nonetheless, many states in the United States exempt bingo games operated by various charitable and religious organizations from their general prohibition on games involving prize, chance, and consideration.

In addition, the lotteries operated by most state governments in the United States and various national, provincial, state, and municipal also clearly involve prize, chance, and consideration. However, these lotteries are not illegal because of specific exemptions in the laws of their respective jurisdictions.

Also, casino games (e.g., roulette) clearly involve prize, chance, and consideration. However, such games are legal when operated in certain regulated environments in certain jurisdictions. For example, there are legal government-licensed casinos in Atlantic City, N.J., but in no other part of New Jersey. Similarly, there are legal riverboat casinos at certain sites in certain states of the United States and there are legal casinos operated on certain Indian lands in the United States. As another example, a limited number of government-licensed casinos operate in London in the United Kingdom.

In contrast, games that do not incorporate all three of the above attributes (that is, prize, chance, and consideration) are generally legal in most jurisdictions (although the legal status of such games varies considerably from jurisdiction to jurisdiction). Thus, in-store promotional games of chance that offer prizes are legal in most states of the United States because participation in the game does not require consideration. Game tickets for such in-store promotional games are typically distributed freely to any store visitor, regardless of whether the visitor makes a purchase in the store. In addition, the operators of such games typically allow anyone to request a game ticket by simply requesting one by mail or telephone. Thus, the player of such a promotional game is not required to purchase the game ticket or to purchase anything else in order to have a chance to win a prize.

Similarly, newspapers and magazines often run promotional games of chance entailing filling out an entry form that appears in the publication. Again, such games are legal in many jurisdictions because they typically give anyone the opportunity to participate in the game merely by making a replica of the entry form or by requesting a free entry form by mail (without purchasing the newspaper or magazine). Also such games are generally legal in many jurisdictions because they do not possess the attribute of consideration.

Similarly, there are numerous games of chance offered on the internet which permit people to play a game of chance in order to win a prize, but require no monetary consideration in order to play. The sites on the internet offering such games typically expose the participant to advertising messages (analogous to the way that an in-store visitor to a store is exposed to various in-store displays enticing, but not requiring, him or her to make a purchase while in the store). These internet games are generally legal in most (or all) jurisdictions in the United States and in many other jurisdictions in other countries because they do not possess all three of the above attributes (that is, prize, chance, and consideration).

Television game shows that offer prizes (whether on the basis of skill alone or a combination of chance and skill) are generally legal because contestants do not pay for the opportunity to participate.

In addition, there are numerous competitions involving skill games (involving, for example, prowess in chess, jigsaw puzzles, golf, bridge, scrabble, and other activities) where the player pays an entry fee in order to participate and in which a prize is offered to the winner of the competition. Such competitions involving skill have the attributes of both prize and consideration. However, if the game involves involve pure skill (such as chess or a jigsaw puzzle, such as the "Eternity Game" in the United Kingdom offering a prize of 1,000,000 pounds sterling), the game does not have the attribute of chance. Competitions involving games (with prize and consideration) that involve pure skill are generally legal in most states of the United States and in many jurisdictions of other countries.

On the other hand, competitions involving games (with prize and consideration) that involve a mixture of both chance and skill (e.g., draw poker) are legal in far fewer jurisdictions. Many jurisdictions apply a test of whether the activity contains any chance whatsoever and, if it does, the activity is deemed to be illegal. Some jurisdictions apply a test of whether the skill component of the activity predominates over the chance component. The determination of whether the skill component of a particular game predominates over the chance component depends on the application of the legal criteria of the jurisdiction involved and the details of the design of the particular game involved.

The prior art contains certain inventions that combine an ordinary casino game of chance with an additional play step based on skill. For example, U. S. Pat. No. 5,718,429, entitled "Method of Combining a Casino Game with a Game of Skill," issued on Feb. 17, 1998, combines a casino game of chance with a second game based on skill. Winning in such a game first requires success in the casino-style game of chance and then additionally requires success in a game of skill.

Network communication, such as the internet, is well known in the prior art. The use of such network communications for the purpose of commerce (so-called electronic commerce or e-commerce) is also well known. There are numerous internet sites that offer various goods and services for sale. It is common in such internet commerce to accept payment by the use of the buyer's credit card. It is not unusual for such sites to require that a potential buyer provide additional information, such as the billing address of the credit card in addition to the credit card number before processing the sale. It is not unusual that access to most of the pages of an internet site are restricted to persons who have preidentified themselves to the operator of the,site by providing, for example, their name, their physical address, demographic information, and their credit card account number.

There are a number of internet casinos in which players pay (typically by credit card) in order to enter a casino-style game of chance (such as roulette) in order to win a prize. These internet casinos are typically located physically in Antigua and other off-shore locations. Such internet casinos typically accept participation from players located in the United States who communicate with the off-shore site by means of the internet. After paying for the opportunity to play, the game of chance is played over the internet for a chance to win a prize. The games offered by such internet casinos possess all three of the attributes of prize, chance, and consideration and would be clearly illegal if conducted inside the United States in the same manner. Most observers believe that such internet casinos are probably illegal in the United States under existing state and federal laws (see Cabot 1999; Sinclair, Schneider, and Balestra 1999) and probably illegal in many jurisdiction of other countries, although this issue has not been adjudicated in the courts to any significant degree as of the time of this writing.

Other Publications

Cabot, Anthony, *The Internet Gambling Report III: An Evolving Conflict Between Technology, Policy, and Law*, Las Vegas, Nev.: Trace Publications, 1999.

Sinclair, Sebastian, Schneider, Sue, and Balestra, Mark, *Wagering on the Internet: Wagering on the Internet*, St. Charles, Mo.: The River City Group, 1999.

Garey, Michael R. and Johnson, David S., *Computers and Intractability: A Guide to the Theory of NP-Completeness*, New York, N.Y.: W. H. Freeman, 1979.

SUMMARY OF THE INVENTION

A skill game is described. In one embodiment, the skill game includes a network communication for enabling communication between a player of the skill game and an operator of the skill game; an identification mechanism for determining that a potential player of the skill game is legally eligible, by virtue of age and location, to participate; a mechanism for preventing the player from participating in the skill game in response to the identification means determining the player is ineligible; a mechanism for receiving consideration from the player to operator of the skill game in exchange for the opportunity to participate in the skill game; a mechanism for providing the player with a game, using said network communication means; and a mechanism for determining whether the player receives a prize, said award criteria being based on skill.

Other objects, features, and advantages of the present invention will be apparent from the accompanying drawings and from the detailed description that follows below.

BRIEF DESCRIPTION OF THE DRAWINGS

The present invention will be understood more fully from the detailed description given below and from the accompanying drawings of various embodiments of the invention, which, however, should not be taken to limit the invention to the specific embodiments, but are for explanation and understanding only.

FIGS. 3A and 3B show part of the information on the screen for playing one embodiment of a president's game in which the correct response to each query is a different president.

FIG. 4 shows the part of the information on the screen for playing one embodiment of a game in which the correct response to each query is a month of the year and in which the same month may be the correct answer to more than one query.

FIG. 5 shows the part of the information on the screen for playing one embodiment of a game in which the correct response to each query is a decade and in which in which the correct response to each query is a different decade.

FIG. 6 shows the part of the information on the screen for playing one embodiment of a crossword game in which all the correct responses belong to the category of geographical places.

FIG. 8 shows the part of the information on the screen for playing one embodiment of a game in which a single five-letter starting word is provided, each response is a word composed of all five letters of that word, and each letter of the starting word is used once and only once in creating a response.

FIG. 9 shows the part of the information on the screen for playing one embodiment of a game in which a single starting word is provided, each response is a word composed of some or all letters of that word, and each letter of the starting word may be used zero, one, or more times in creating a response.

FIG. 10 shows the part of the information on the screen for playing one embodiment of a game in which the correct response to each query is one of the seven days of the week and in which the correct response to each query is a different day.

FIG. 13 shows the part of the information on the screen for playing one embodiment of a game in which the correct response to each query is the first name of a person.

FIG. 23 shows a menu presenting information about four illustrative skill games.

FIG. 24 shows a menu presenting information about a hierarchical arrangement of skill games.

DETAILED DESCRIPTION OF THE PRESENT INVENTION

Figure 1:
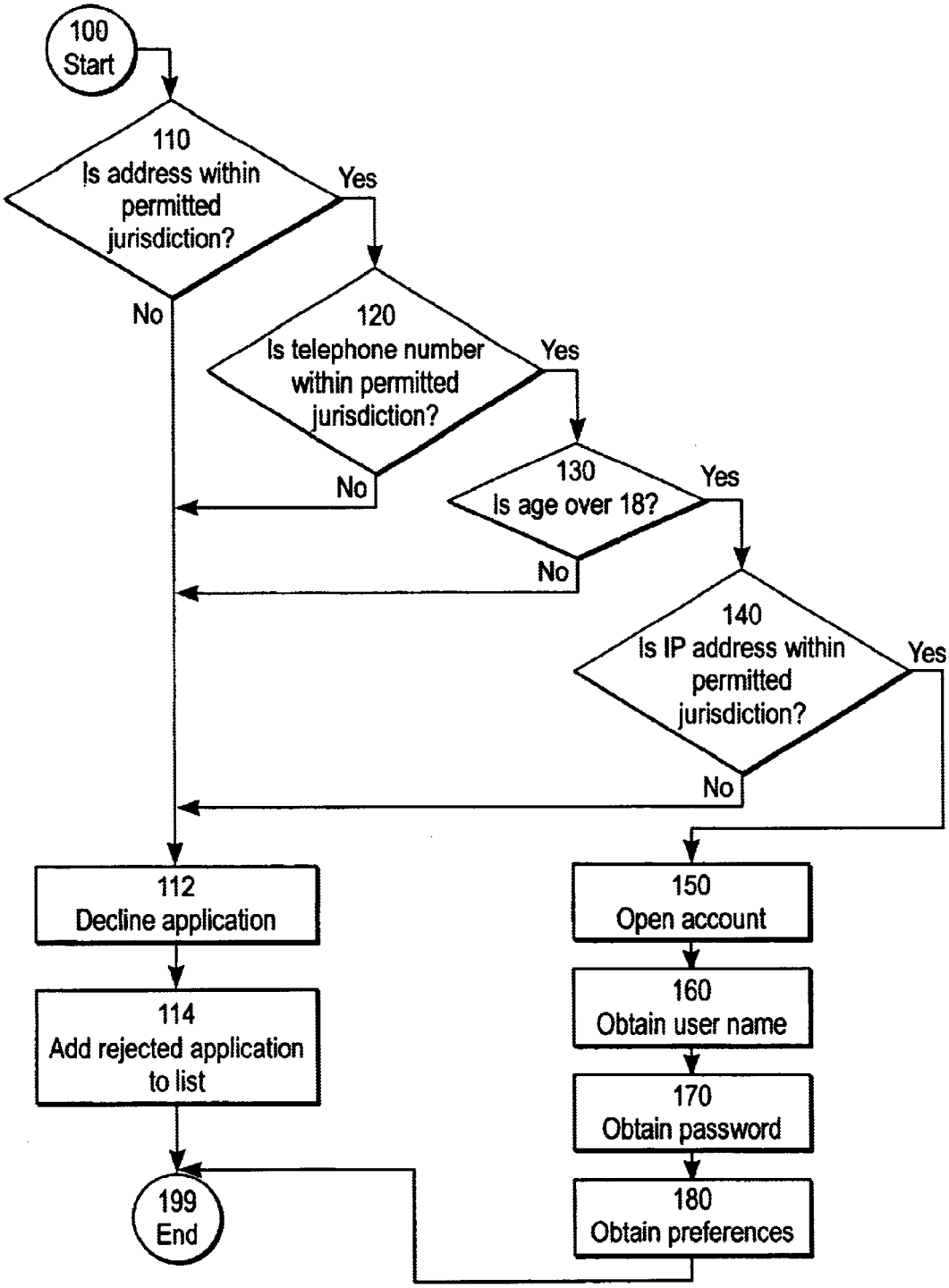
FIG. 1 is a flowchart showing the process by which a potential player opens an account.

Skill games are described that are implemented using network communications. It should be emphasized that the subject matter of the present invention concerns games of skill that are clearly legal, under current law, in most states of the United States and in many jurisdictions of other countries.

In the following description, numerous details are set forth. It will be apparent, however, to one skilled in the art, that the present invention may be practiced without these specific details. In other instances, well-known structures and devices are shown in block diagram form, rather than in detail, in order to avoid obscuring the present invention.

Some portions of the detailed descriptions that follow are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The present invention also relates to apparatus for performing the operations herein. This apparatus may be specially constructed for the required purposes, or it may comprise a general purpose computer selectively activated or reconfigured by a computer program stored in the computer. Such a computer program may be stored in a computer readable storage medium, such as, but is not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions, and each coupled to a computer system bus.

The algorithms and displays presented herein are not inherently related to any particular computer or other apparatus. Various general purpose systems may be used with programs in accordance with the teachings herein, or it may prove convenient to construct more specialized apparatus to perform the required method steps. The required structure for a variety of these systems will appear from the description below. In addition, the present invention is not described with reference to any particular programming language. It will be appreciated that a variety of programming languages may be used to implement the teachings of the invention as described herein.

Network Communications

A skill game is described in which network communication allows a potential player of the skill game to communicate with an operator of the skill game. The network communication is described herein in terms of the internet, although other network communication mechanisms may be used.

In one embodiment, a potential player initiates contact with the operator of the skill game by the use of the internet and is presented with a home page (and additional pages) of an internet site that describes the skill game and the eligibility requirements for entering the skill game. Access to the remainder of the pages of the internet site are restricted to persons who have previously identified themselves to the operator of the skill game and have successfully opened an account.

In one embodiment, a potential player interested in opening an account provides the operator of the site with his or her name, age, physical address, telephone number, and electronic mail (e-mail) address. In one embodiment, the state and country of the address are entered by the use of menus listing all the states or provinces of each country. All requested information are required before the operator of the site considers the eligibility of the potential player. When the player has provided the requested information, the information is processed by the operator of the site.

FIG. 1 is a flow diagram of one embodiment of a process for opening an account. The process is performed through the use of processing logic that may comprise hardware, software, or a combination of both. In general, players of the skill game must be located in a jurisdiction where the skill game of the type being offered is legal. The processing logic may be located, at least in part, at the location of the operator of the skill game.

Referring to FIG. 1, the process begins by processing logic checking the physical address entered by the user to determine if it is in a permitted jurisdiction (processing block 110). If the physical address is not within such a jurisdiction, processing logic declines the proffered account (processing block 112). In that event, in one embodiment, processing logic may advise the potential player that he or she is not eligible to participate, the account is not opened, and the processing logic prevents the potential player from gaining access to the remainder of the site.

In one embodiment, processing logic retains the information about the declination of the potential player and adds the potential player to a list, which is stored (processing block 114). Information on the list of declined application is compared with information contained in all future applications. If a subsequent application is made (particularly if made soon after the first application by the same apparent potential player, but with slightly different information), the new application may be declined on the assumption that the information that was first provided is more likely to be accurate.

If the address is in a permitted jurisdiction, processing logic checks the telephone number to determine if it is in a permitted jurisdiction (processing block 120). If the telephone number is not within such a jurisdiction, processing logic declines the proffered account (process block 112). As before, processing logic advises the potential player that he or she is not eligible to participate, does not open the account, and does not provide the potential player with access to the remainder of the site.

In one embodiment, players of the skill game must be of at least age 18. In such a case, the process of opening an account also includes processing logic requests the age of the individual and tests whether the individual is over 18 years of age (processing block 130). If the potential player is not of age 18 or older, the proffered account is declined (at the point labeled 112 in FIG. 1). As before, processing logic advises the potential layer that he or she is not eligible to participate, does not open the account, and does not provide the potential player with access to the remainder of the site.

In addition, the process of opening an account also includes processing logic determining if the IP address is within the permitted jurisdiction (processing block 140). In this manner, the processing logic considers the latitude and longitude of the internet service provider (or server directly connected to the internet) that originated the communication to the operator of the skill game. The geographic location (e.g., street address, city, as well as the latitude and longitude) of internet service providers and each server directly connected to the internet are generally known and are part of the public database of information about the internet. Thus, it is possible to determine whether such internet service provider or server is within a permitted jurisdiction.

The operator of the site generally relies on the correctness of the information asserted by potential players. However, in one embodiment, the asserted information is also tested for internal consistency. In one embodiment, the process of opening an account includes processing logic determining the location of the telephone number of the proffered account to determine if it is consistent with the physical address of the proffered account. For example, the area code of the telephone number indicates the portion of a state of the United States (or province of Canada or state of Australia) in which the telephone is located. The next three digits of the telephone number generally indicate the particular local area in which the telephone is located.

Similarly, in another embodiment, the asserted information concerning the physical location of the potential player is further tested by processing logic for internal consistency with respect to the latitude and longitude of the machine or internet service provider that originated the communication to the operator of the skill game.

In one embodiment, in addition to relying on the information provided by the potential player and to checking that information for internal consistency, the address of a potential player and the age of a potential player is independently checked, using processing logic, against the address and age contained in records held by the issuer of a credit card being used. It is advantageous to rapidly implement this additional checking, using network communications and processing logic, at the same time that the application of the potential player is being processed.

If the application of the potential player is accepted, processing logic assigns and opens an account number (processing block 150). Processing logic obtains an individual user name selected by the account holder for the account (processing block 160) and obtains a password selected by the account holder for the account (processing block 170).

At the time of opening an account, processing logic may receive certain preferences established by an account holder regarding the handling of his account (processing block 180). An account holder may subsequently modify these preferences at any later time when he has logged on to his account. In one embodiment, these preferences include specifying whether the player wants to receive a monthly statement of his account balance by, for example, e-mail and whether the player wants to receive announcements by, for example, e-mail of new games available at the site.

Once a player has opened an account, he may then log on to his account at any time. In one embodiment, when the player logs on to his account, he is presented with information about the current balance in his account. Initially, the player's account has a zero balance. In one embodiment, a player may add money to his account using a credit card. If a player desires to add money to his account using a credit card, he enters the card number, expiration date, and, in one embodiment, the billing address of the credit card. The site attempts to validate the proffered credit card transaction (using techniques that are well known in the art), and, if validated, adds the selected amount of money to the player's account. A player may also add money to his account by sending a check to the operator of the site. In that event, the operator cashes the check and adds the money to the account and notifies the player (in one embodiment, by e-mail). In one embodiment, account holders can close their account at any time. Any money remaining in such closed accounts is sent to the account holder by check. In an alternative embodiment, money is sent to the account holder by techniques for electronic funds transfer that are well known in the prior art.

Figure 2:
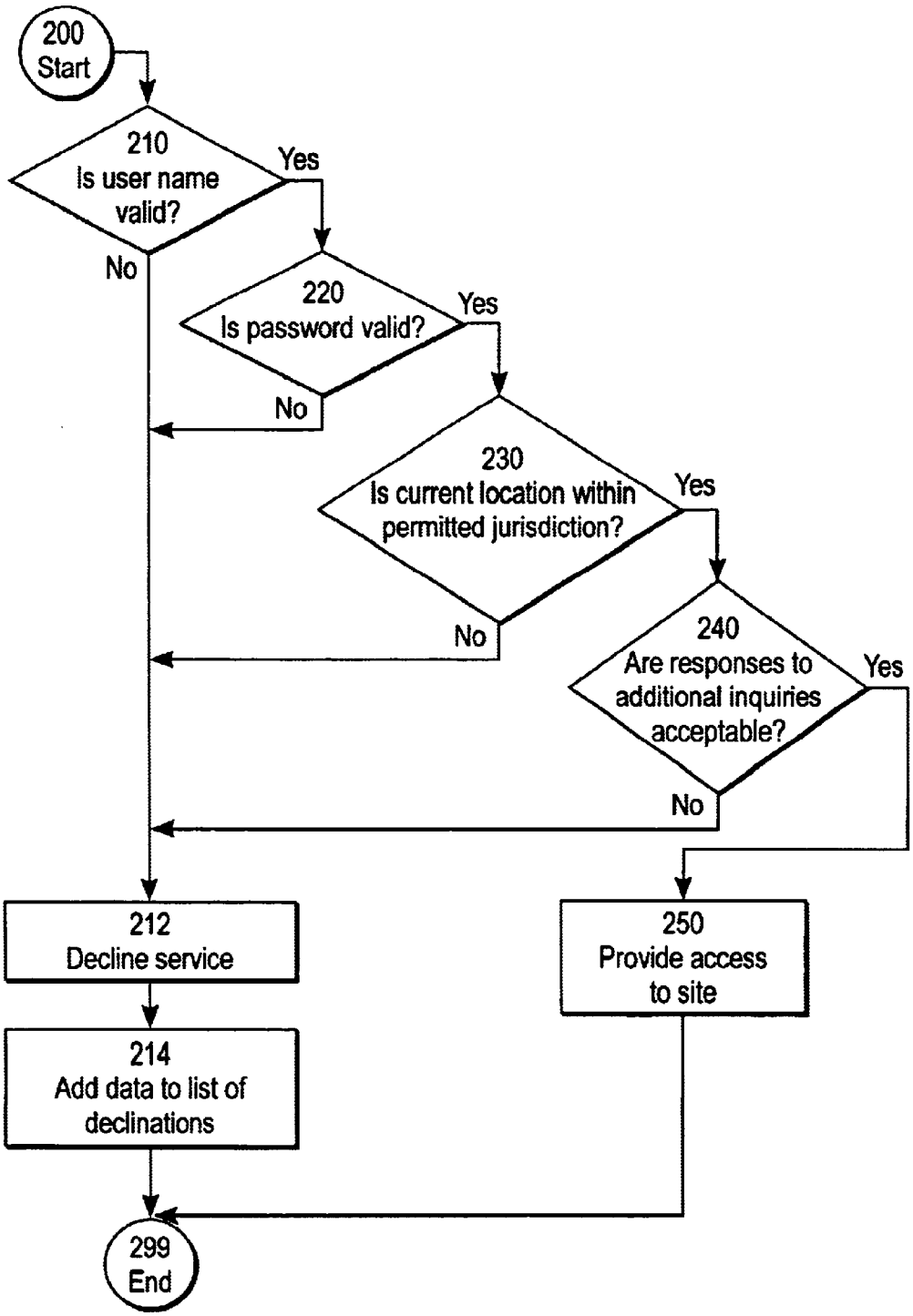
FIG. 2 is a flowchart showing the process by which a player logs on to his account.

FIG. 2 is a flow diagram of one embodiment of a process for logging in a player and enabling the player's participation in a skill game. The process is performed by an operator having processing logic that may comprise hardware, software or a combination of both.

Referring to FIG. 2, the process begins by the operator receiving a user name (processing block 210) and password (processing block 220) provided by a potential player. If a correct user name is not provided, the operator declines access to the site (processing block 212). Also, if a correct password for the proffered user name is not provided, the operator of the site declines access (processing block 212). Processing logic records information about the failed entry on a list of declinations (processing block 214).

In one embodiment, the process by which a player logs on to an account additionally includes processing logic of the operator determining whether the latitude and longitude of the machine or internet service provider that originated the current communication with the operator of the skill game is within a permitted jurisdiction (processing block 230). If the current communication did not originate within a permitted jurisdiction, the operator of the site declines access (processing block 212).

The process by which a player logs on to an account may additionally include, in one embodiment, processing logic providing additional inquiries to the potential player by use of screens that appear on the player's video screen. In one embodiment, the additional inquiries include asking the potential player to assert (e.g., by clicking on a YES or NO button) that he is indeed the person who owns the account (processing block 240). If the answer is negative, the operator of the site declines access (processing block 212). Also, in one embodiment, the additional inquiries include asking the potential player to assert (e.g., by clicking on a YES or NO button) that he is over the age of 18 (processing block 240). If the answer is negative, the operator of the site declines access (processing block 212). Finally, in one embodiment, the additional inquiries include asking the potential player to assert (e.g., by clicking on a YES or NO button) that player's current physical location is in a jurisdiction in which participation in the skill game is legal (processing block 240). In one embodiment, this additional inquiry is based on whether the player is using the same telephone number that was used in originally opening his account. If the answer is negative, the operator of the site declines access (processing block 212).

If the answers to these inquiries are all satisfactory, processing logic of the operator logs the player into his account and provides access to the site (processing logic 250).

In one embodiment, whenever any player logs on to the site, the time, the player's account number, user name, and IP address associated with the current communication is entered into a log for administrative purposes.

After successfully logging on to his account, the player may browse the site. In one embodiment, a variety of different skill games are available to the player at the site. The characteristics of each skill game that is offered is presented to the player. Such characteristics may include the name of the game, the subject matter of the game, the method of playing the game, the price for playing the game, the criteria for winning the game, and the prizes available for winning. In one embodiment, these characteristics include the number of previous players of the game and the numbers of prizes won by previous players. In one embodiment, a practice or sample instance of each game is provided to illustrate the play of the game to the player.

At some point, the player may choose to participate in a particular skill game available at the site. The player's account is then debited by the consideration (e.g., $1) for participating in such skill (assuming that the required amount is presently in the account). Each transaction is entered into a perpetual log (used for accounting and administrative purposes) indicating the player's account number, user name, time of transaction, an amount of the transaction. The player then plays the skill game.

FIGS. 3A and 3B show a skill game that uses several different queries based on knowledge about the presidents of the United States. In one embodiment, the queries are presented in the form of hints (e.g., in the style commonly used in crossword puzzles). For example, the queries in FIGS. 3A and 3B are presented in the form of hints 310, the first of which is the hint "President who served non-consecutive terms." Similarly, the queries of FIG. 4, FIG. 6, FIG. 10, and FIG. 13 are also presented in the form of hints. In an alternative embodiment, queries are presented in the form of direct questions. For example, the queries in FIG. 5 are presented in the form of direct questions 510, of which the first is the direct question "In what decade was the first woman elected to the U.S. Senate?"

In one embodiment, all the responses in the skill game belong to a category having a known and relatively small number of elements. For example, all the responses to the particular skill game in FIGS. 3A and 3B are the names of the 41 presidents (indicated by 320 in FIGS. 3A and 3B). Other such games involve, for example, the names of the 50 states of the United States, the names of the 12 months of the year (as illustrated in FIG. 4), the 31 days of the month, the 10 decades of the Twentieth Century (as illustrated in FIG. 5) or other specified groups of ranges of years, and the seven days of the week (FIG. 10). Similar games can be constructed from other categories having a known and relatively small number of elements (e.g., provinces of Canada, kings and queens of England, states of Australia).

In the embodiments shown in FIGS. 3A and 3B, FIG. 4, FIG. 5, FIG. 10 and FIG. 13, the method by which a player indicates his responses to the queries is to check off the name of a particular president (e.g., by clicking on an internet screen using a mouse). For example, the player would check off six responses from among the 41 possible responses in the area labeled 320 of FIGS. 3A and 3B.

Figure 15:
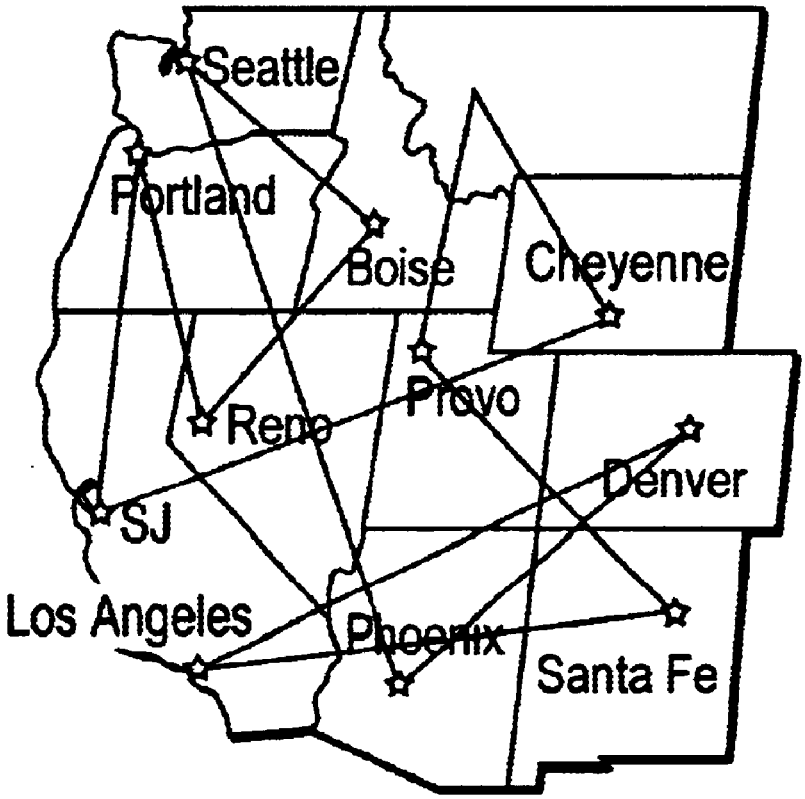
FIG. 15 shows a non-optimal itinerary connecting the 12 cities of FIG. 14.
Figure 18:
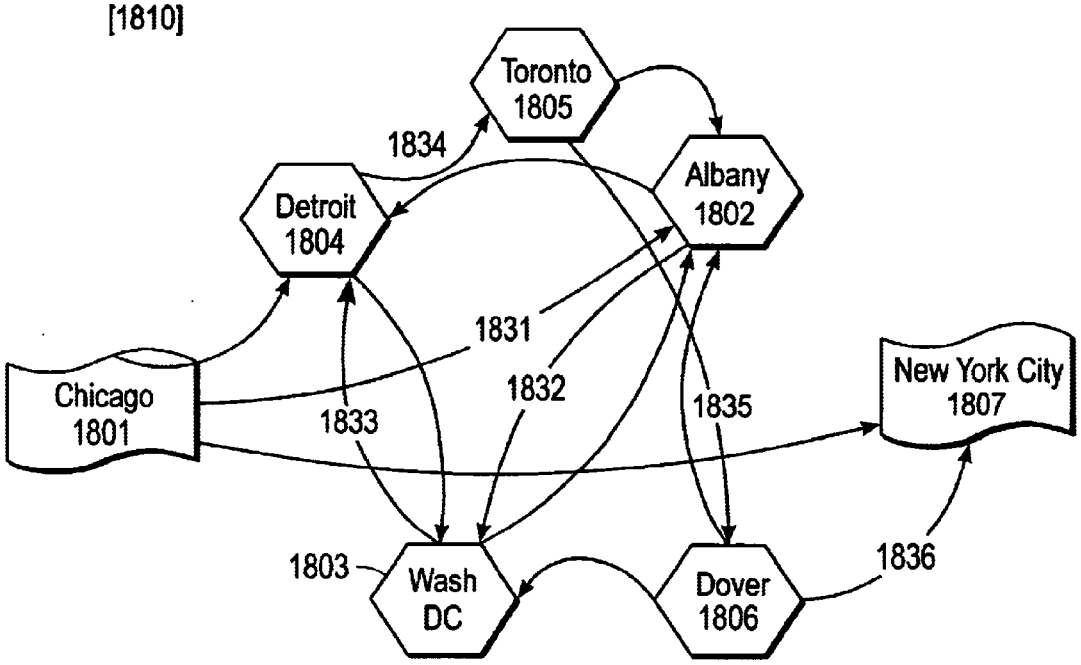
FIG. 18 shows the part of the information on the screen for playing one embodiment of a game involving creating a Hamiltonian path between points.
Figure 19:
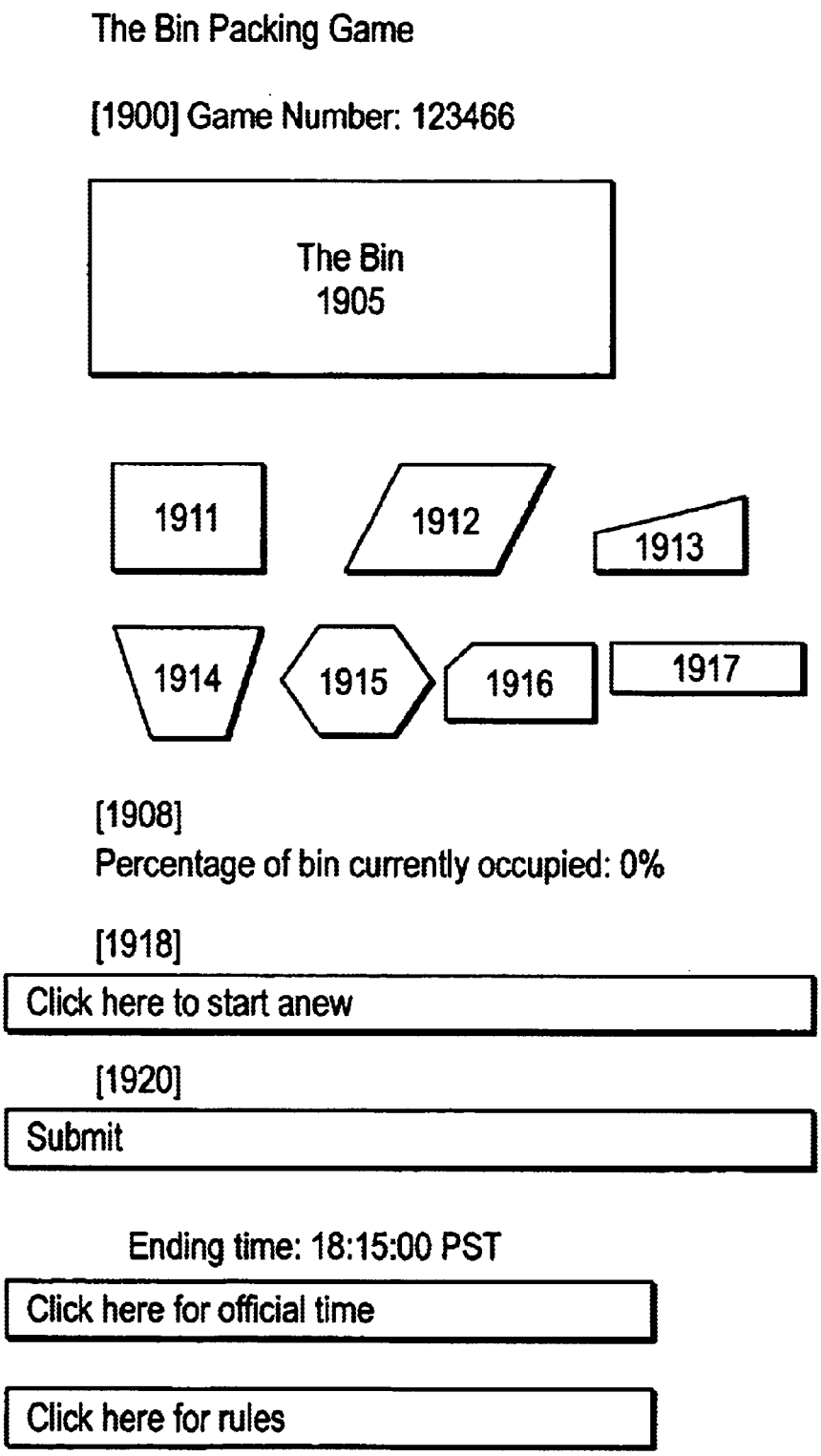
FIG. 19 shows the part of the information on the screen for playing a bin packing game.
Figure 22:
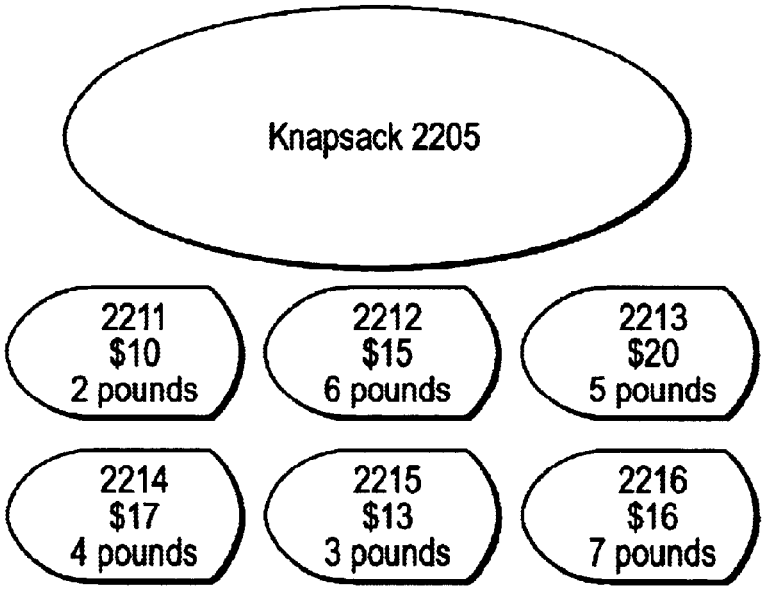
FIG. 22 shows the part of the information on the screen for playing a knapsack game.

There are numerous alternative means by which a player may indicate his responses to the above-mentioned skill games (FIGS. 3A, 3B, 4, 5, 10 and 13) and other skill games described subsequently herein. For example, in an alternative embodiment, the player may indicate his responses to the skill games of FIGS. 3A, 3B, 4, 5, 10 and 13 by typing the response (in the manner illustrated by FIGS. 6, 8, and 9). In another embodiment, the player may click on a special icon, drag the icon, and then drop the icon onto the names of each of the six presidents constituting his response (for the game illustrated by FIGS. 3A and 3B). In yet another embodiment, the player may click on the name of a president constituting his response, drag the name, and drop the name into a special area (perhaps a ballot box or other icon appropriate to the subject matter of the game). In yet another embodiment, the player may speak the word corresponding to his response. Existing speech recognition technology is capable of recognizing single spoken single words from a preidentified small repertoire of possible words. This approach is especially appropriate for the skill games illustrated by FIGS. 3A, 3B, 4, 5, 10, 13, 15, 18, 19, and 22 where there is a small repertoire of possible responses. Existing speech recognition technology is currently especially efficient and robust at recognizing spoken numbers. Thus, depending on the nature of the words in the repertoire of possible responses for a particular skill game, it may be advantageous to assign a number to each of the possible answers (e.g., 1 for George Washington, 2 for John Adams, and so forth for the 39 other presidents). The player's response would then be a number and existing speech recognition technology can then be efficiently used to recognize the player's response. Similarly, existing speech recognition technology may be used for skill games in which the player's response consists of an unordered list of objects (each of which may be represented by numbers) as illustrated in FIGS. 19 and 22 and for skill games in which the player's response consists of an ordered set of city names (each of which may be represented by numbers) as illustrated in FIGS. 15 and 18.

In one embodiment, such as the skill game illustrated in FIGS. 3A and 3B, no element (i.e., president) in the list is the correct answer to more than one query. In this embodiment, only one list of the possible responses is provided and the player marks off the names of the six elements that he thinks are the correct responses to the six queries. An attractive screen appropriate to the subject matter of the skill game (e.g., presidents, geography, history) is provided to the player on which he can check off his choices based on his knowledge in the subject matter of the skill game.

In an alternative embodiment, an element in the list may be the correct answer to more than one query. In that event, one list of the possible responses is provided for each separate query and the player marks off the element that he thinks is the correct answers to each particular query. FIG. 4 shows the part of the information on the screen for playing a game in which the correct response to each of the three queries is a month of the year and in which the same month may be the correct answer to more than one of the three queries. The queries (in the form of hints) are at the point labeled 410 in FIG. 4. The player can check off one response from among the 12 possible responses in each of the three columns in the area labeled 420 of FIG. 4. In an alternate embodiment, the 12 signs of the zodiac may be used in place of the names of the 12 months.

In yet another alternative embodiment, FIG. 5 shows the part of the information on the screen for playing a game in which the correct response to each of two queries is a decade of Twentieth Century and in which in which the correct response to each query is a different decade.

If any response may be the correct response to any of the queries (as is the case in FIG. 4), then there are $N^Q$ possible ways of responding in the skill game if there are N possible responses to a query and there are Q queries. In the example of FIG. 4 involving 12 elements and three queries, there are thus 1,728 possible ways of making three responses. If there is exactly one correct answer for each of the three queries, one of these 1,728 ways of making three responses would be the correct answer for all three queries.

In contrast, when a response is the correct response to no more than one query (as is the case in FIGS. 3A and 3B and FIG. 5), then there are $N!/[Q!(N-Q)!]$ possible ways of responding if there are N possible responses to a query and there are Q queries. (The exclamation point represents the factorial function, where N! is the product of the integers between 1 and N). In the example of FIG. 5 involving 10 elements and two queries, there are 45 possible ways of responding when a response is the correct response to no more than one query. In the example of FIGS. 3A and 3B involving 41 elements and six queries, there are 4,496,388 possible ways of responding when a response is the correct response to no more than one query.

In one embodiment, the responses in the skill game belong to a large identified category; however, only a small subset of that category (including all the correct answers) is presented to the player as possible responses for that game. For example, all the responses may be first names of persons; however, only a limited number of first names may be presented to the player. In one embodiment, the identified categories may be historical figures or entertainment personalities. FIG. 13 shows the part of the information on the screen 1300 for playing a game in which the correct response to each query is the first name of a person and in which the correct response to each query is a one of 12 first names 1320 provided to the player. Two queries in the form of hints 1310. When the player completes his proposed solution, he clicks on the button entitled "Click here to submit your answers".

In one embodiment, the player is given only a limited total amount of time to play a game. In such an embodiment, the skill game ends after a specified amount of time (as shown at the point labeled 330 in FIGS. 3A and 3B and at similar points in other figures). The player may obtain the official time at the site of the operator by clicking on a button or icon (as shown at the point labeled 350 in FIGS. 3A and 3B and at similar points in other figures).

In one embodiment, the game is delivered to all the players at the same time (or approximately the same time). In this embodiment, after a player requests to participate in a game, his participation does not begin until the simultaneous beginning of the game for all players of that particular game. In another embodiment, after a player requests to participate in a game, his participation begins immediately. In one embodiment, the same game may be presented to different players at different times.

When the player finished his play of the game (e.g., responded to all the queries in the case of a query game), the player submits his responses to the operator of the skill game by clicking a button or icon (as shown at the point labeled 330 in FIGS. 3A and 3B and at similar points in other figures) that transmits his response to the operator. In one embodiment, the player receives an acknowledgment for each submission.

For each skill game, the rules that govern that game are presented on a special screen that is accessible by clicking on a button or icon (as shown at the point labeled 360 in FIGS. 3A and 3B and at similar points in other figures). These rules contain the authority for the correct answer (e.g., a particular dictionary or geographic atlas).

Each skill game that is offered bears a unique perpetual number for purposes of accounting and administration. For example, the game shown in FIGS. 3A and 3B is numbered 123456 (as shown at the point labeled 300 in FIGS. 3A and 3B and at similar points in other figures).

The determination of whether the player receives a prize is based on skill. The award criteria for each skill game is clearly stated to the player as part of the description of the game that is available prior to the commencement of play of that game. In one embodiment, the award criteria involve correctly answering all the queries. In an alternative embodiment, the award criteria involve correctly answering more queries than other player participating in that particular skill game.

In another alternative, the award criteria involves awarding one prize for correctly answering a certain number (perhaps all) the queries and a different (typically lesser) prize for correctly answering a smaller specified number of the queries. In another embodiment, one prize entitles the player to make a play of another skill game offered by the operator of the site.

In yet another embodiment, the award criteria additionally favors the speed of the player is submitting answers to the queries, thereby combining both knowledge skill and speed skill. Thus, for example, if more than two players correctly answer all the queries, the player who first submits correct responses to all the queries would be preferred over a slower player who also submits correct responses to all the queries. Other examples of award criteria are presented below in connection with other types of games described below.

Each player of a particular game is informed of the outcome of the game. In one embodiment, the player is informed of the outcome of the game within moments of the time when he submits his response. This approach is especially suitable if all players are playing the game with the same starting and ending times. In an alternative embodiment, the player is informed of the outcome by e-mail. This approach is especially suitable if multiple players are playing the same game with staggered starting and ending times.

In another embodiment, if no player satisfies the award criteria of a particular skill game, the prize available in that game (or a designated part thereof) is added to the prize that would ordinarily be offered in a subsequently offered skill game.

When a player wins a prize in a skill game, the amount of the prize is added to his account. The player may use the money in his account to play additional game(s). In addition, a player who has won a prize may, at any time, request that the operator of the site send a check to the physical address that he has provided for the amount of the prize or for any or all of the money currently in his account. When a check is sent to a player, the amount of the check is debited from the player's account. In an alternative embodiment, money may be sent to the account holder by techniques for electronic funds transfer that are known in the art. In another embodiment, money may be transferred to the account holder by a direct credit to his credit card account. In this embodiment, the operator of the skill game compensates the manager of the credit card account for the amount of the transfer (plus the fee charged for the transfer by the manager of the credit card account).

In another embodiment, the possible responses to the queries belong to an identified category consisting of a very large number of possibilities. Examples are skill games where the possible responses are the names of geographic places, historical events, dates, biographic figures, entertainment personalities and their works, words, or numbers. In this embodiment, no list of possible responses is presented to the player. The player indicates his responses to a query by typing in his response onto a space provided on his screen. In one embodiment, the number of letters in the correct response is indicated to the player by providing a particular number of blank spaces in which to insert a letter (such as, for example, illustrated in FIG. 8 where all responses are to consist of five letter words and as also illustrated by the crossword-style form of FIG. 6 that indicates the number of letters in each response). In an alternative embodiment, the number of letters in the correct response is open-ended and the number of letters is not indicated to the player (such as, for example, illustrated by FIG. 9).

Figure 7:
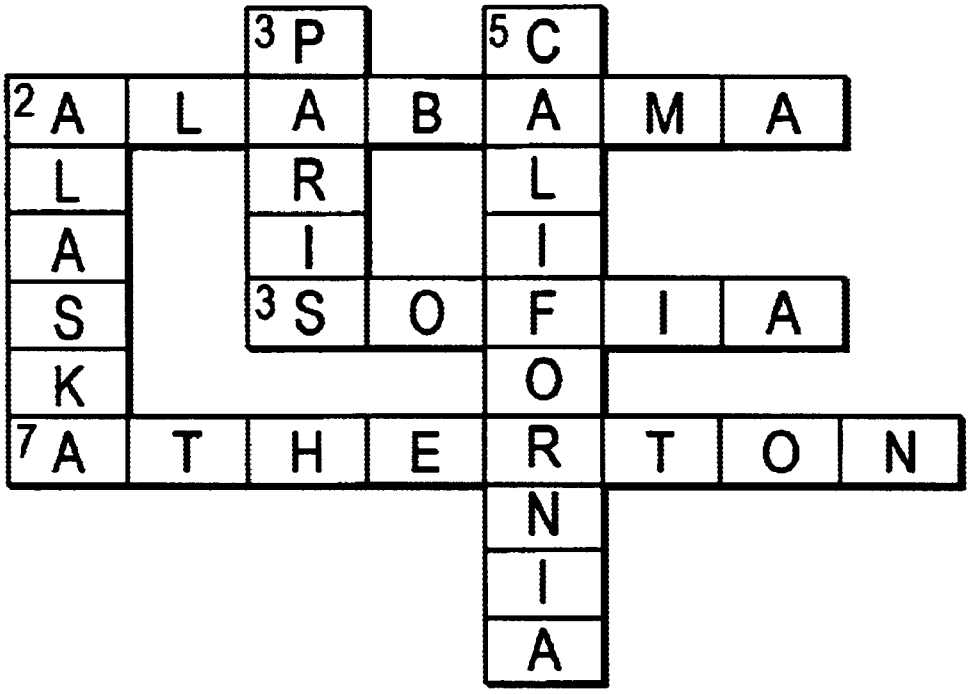
FIG. 7 shows the correct responses to the crossword game of geography of FIG. 6.

In yet another embodiment, the player is provided with a visual presentation in at least two dimensions of possible responses in the familiar style of a crossword puzzle. FIG. 6 shows part of the information on the screen for playing a crossword game in which all the correct responses belong to the category of geographical places. FIG. 7 shows the correct responses belong to the crossword game of geography of FIG. 6. The visual presentation 620 indicates the number of letters of the alphabet in each correct response. As in crossword puzzles, words are laid out in the horizontal or "across" direction, such as the seven-letter word beginning at the point labeled 2 and words are additionally laid out in the vertical or "down" direction, such as the five-letter word beginning at the point labeled 3. As in crossword puzzles, there are numerous instances where a letter in the correct response to one of said queries (e.g., a word laid out in the vertical or "down" direction) intersects with a letter in the correct response of another of queries (e.g., a word laid out in the horizontal or "across" direction). Such an intersection is illustrated by point 630 in FIG. 6. Point 630 is the second letter of the five-letter vertical word beginning at the point labeled 3 and is the third letter of the seven-letter horizontal word beginning at the point labeled 2. In an alternative embodiment, one or more correct letters may be provided as clues to the player. In one embodiment, all the correct entries in the crossword belong to a particular category, such as the names of geographic places, historical events, biographic figures, or entertainment personalities and their works.

In yet another embodiment, the crossword may be presented in three dimensions. Techniques for displaying objects in three dimensions are well-known in the prior art.

In yet another embodiment (e.g., FIG. 8, FIG. 9, etc.), the player is provided with a single starting word, single starting number, multiple starting words, or multiple starting numbers. For example, there is a single starting word, STEAK, at the point labeled 810 in FIG. 8 and there is a single starting word, ARITHMETIC, labeled 910 in FIG. 9. In this letter reallocation game, each response is a word composed of letters of the starting word(s). This skill game may be played in various ways. For example, in one embodiment, each letter of the starting word may used once and only once in creating each response (so that the responses are words of the same length as the starting word). FIG. 8 shows the part of the information on the screen for playing a game in which a single five-letter starting word (STEAK at the point 810) is provided, each response is a word composed of letters of that word, and each letter of the starting word is used once and only once in creating each response. Thus, correct responses in the game with a five-letter starting word of STEAK include (but are not limited to) words such as STAKE, SKATE, and TAKES. As shown in FIG. 8, all responses contain five letters. The player can type in the letters of responses such as STAKE, SKATE, and TAKES in the area labeled 820 in FIG. 8 in which each line accommodates exactly five letters.

In another embodiment, each response is a word composed of letters of that word, but each letter of the starting word may be used zero, one, or more times in creating a response and it is not necessary to use all the letters. FIG. 9 shows the part of the information on the screen for playing a game in which a single starting word is provided, each response is a word composed of letters of that word, and each letter of the starting word may be used zero, one, or more times in creating a response. Thus, correct responses in this skill game with a starting word of ARITHMETIC include (but are not limited to) words such as METRIC, HARE, THE, and TART. Note that the word TART is a correct response to this version of this game. However, in an alternate embodiment, a letter of the starting word may only be used as many times in the response as it appears in the starting word. In that version of the game, the word TART would not be a correct response. The player can type in the letters of a response, such as METRIC, on the first line of the area labeled 920 in FIG. 9.

Skill determines whether a particular players wins a prize in any of the games represented by FIGS. 3, 4, 5, 6, 7, 8, 9,

10, 13, 14, 16, 18, 19, and 22 (and the variations of them mentioned herein).

In an alternative embodiment, a game may include a chance component in addition to the skill component. The jurisdictions in which such a game is legal would, in general, be fewer than for a game of pure skill. The legality of such a game would depend on the application of the legal criteria of the jurisdiction involved to the details of the design of the game involved.

In games of chance, it is often possible to compute the probability of winning the game using mathematical principles. For example, in the three-digit "daily numbers" game (which is offered by many state-operated lotteries in the United States), the player enters a daily lottery game by choosing a three-digit number. At the specified time in the evening, a random drawing is conducted in order to select the day's winning three-digit number. The selection of the three numbers may be done using three wheels, each of which is divided into 10 parts. The three wheels are each spun (typically as part of a one-minute television show). The place where the first wheel stops determines the first digit of the day's winning number. The places where the second and third wheels stop determine the second and third digits, respectively, of the day's winning number. In this game of chance, a player's probability of winning are 1 in 1,000. This probability is computed from the fact that there are 1,000 possible combinations of three digits and each is equally likely to be drawn in the drawing.

In contrast, the probability of winning a skill game cannot be computed in advance in a similar way. The probability that a particular player will win depends on the player's individual skill (e.g., knowledge) of the subject matter of the particular skill game involved. Moreover, the number of winners of a skill game depends on the skill of the various individual players of the group. Thus, the operator of as particular skill game generally assumes a certain amount of risk based on the accuracy of estimates of the of the number of winners in the anticipated group of players.

A potential player of the above-described skill games may advantageously communicate with the operator of the skill game by means of network communications, such as the internet. The originator of communication on the internet is typically either a computer that is directly connected to the internet (as is the case with many business, industrial, educational, and governmental users and some individual residential users) or a computer that makes a connection indirectly by a connection over local telephone service to an internet service provider (ISP) who is, in turn, directly connected to the internet. Individual residences and business are also sometimes connected to the internet by the use of a cable and other mechanisms. When a web site is visited on the internet, the IP address of the server or internet service provider originating the connection is generally known to the internet site.

When a potential player asserts a physical address as part of the process of opening a new account (FIG. 1) or attempts to log on to an account (FIG. 2), this assertion by the potential player can be compared to the known geographic location (latitude and longitude) of the computer that is directly connected to the internet or the computer that is indirectly connected to the internet by a connection over local telephone service to an internet service provider (ISP). Participation can be disallowed if the assertion does not match known information about the geographic location of the IP address from which the potential player is communicating with the operator of the skill game.

In one embodiment, the operator of the skill game also operates (or arranges for the operation of) servers on the internet or internet service providers whose incoming telephone lines are equipped with techniques for caller identification of telephone calls. The well-known techniques of caller identification permit the determination of the telephone number that called the server or internet service provider. The telephone number is indicative of the geographic area from which the telephone call originated.

The Neo Trace software (Version 2.12a dated Feb. 1, 2000) provides one way to identify communication paths over the internet. For purposes of illustration, potential player is assumed in Los Altos, Calif. and the operator of the skill game is assumed to be in San Diego, Calif. Network communication over the internet typically occurs in a sequence of hops starting from a server or an internet service provider at the origin of the communication, traveling between various intermediate network service providers, and eventually reaching the internet service provider or server at the destination.

Figure 11:
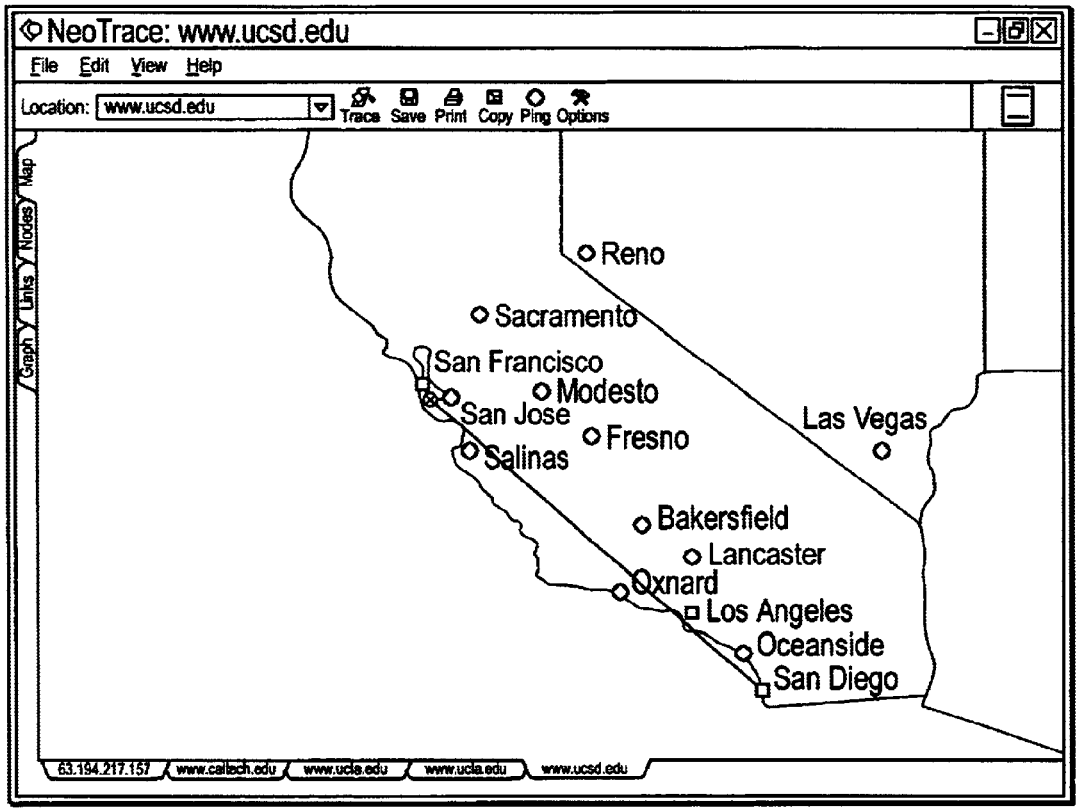
FIG. 11 shows an illustrative communication path originating at a computer that is located in Los Altos Hills, Calif. and terminating at a computer in San Diego, Calif.

FIG. 11 shows an illustrative communication path originating at a computer name "huxley" (whose IP address on the internet is 172.16.0.3) that is located in at 37.385 North latitude and 122.113 West longitude in Los Altos Hills, Calif. and terminating at www.ucsd.edu at the University of California in San Diego (IP address 132.239.50.184 at infopath.ucsd.edu) located at 32.708 North latitude, 117.142 West longitude.

Figure 12:
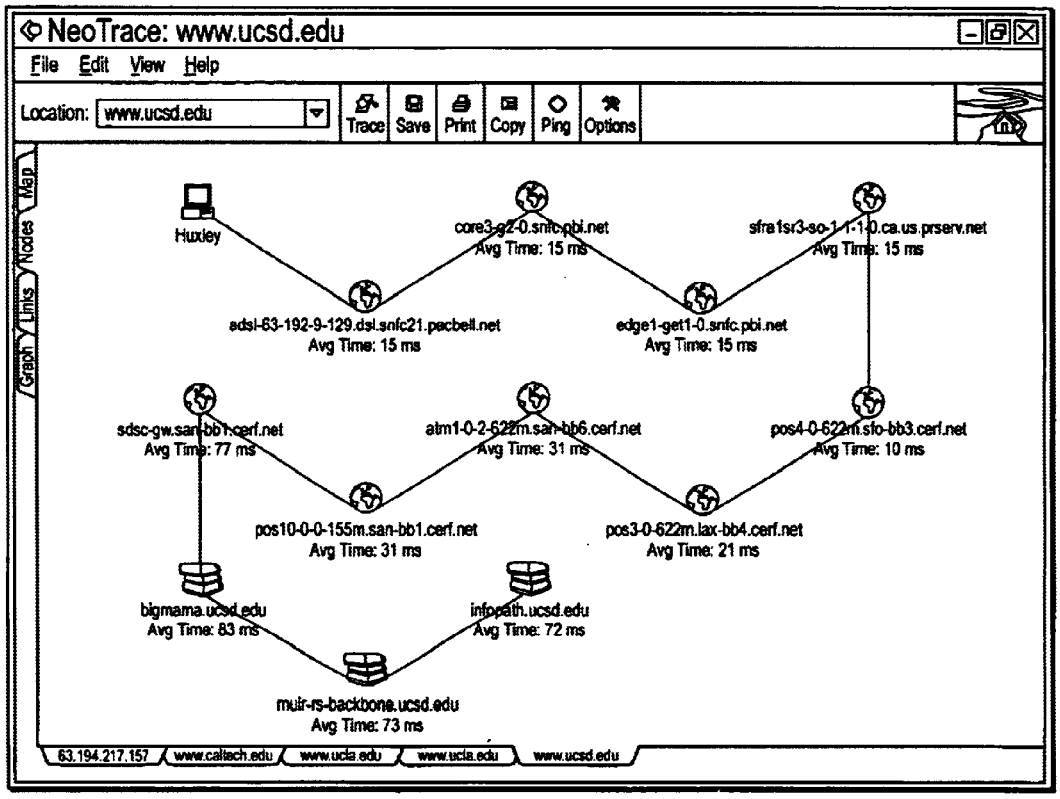
FIG. 12 shows the 13 hops in the illustrative communication path shown in FIG. 11.

Table 1 and FIG. 12 show the 13 hops in the illustrative communication path shown in FIG. 11. As is shown in both Table 1 and FIG. 12, the illustrative communication shown in FIG. 11 first travels north from Los Altos Hills to San Francisco to Pacific Bell Internet Services (whose IP address is 63.192.9.129 at adsl-63-192-9-129.dsl.snfc21.pacbell.net and further identified as "PACBELL2-DOM") and proceeds south over the remaining hops of the communication path until it reaches its destination in San Diego.

TABLE 1

Illustrative internet communication path

| Hop | Machine | IP address |
|---|---|---|
| 1 | huxley | 172.16.0.3 |
| 2 | adsl-63-192-9-129.dsl.snfc21.pacbell.net | 63.192.9.129 |
| 3 | core3-g2-0.snfc21.pbi.net | 206.171.134.130 |
| 4 | edge1-ge1-0.snfc21.pbi.net | 209.232.130.20 |
| 5 | sfra1sr3-so-1-1-1-.ca.us.prserv.net | 165.87.161.74 |
| 6 | pos4-0-622m.sfo-bb3.cerf.net | 134.24.32.189 |
| 7 | pos3-0-622m.lax-bb4.cerf.net | 134.24.29.234 |
| 8 | atm1-0-2-622m.san-bb6.cerf.net | 134.24.32.61 |
| 9 | pos10-0-0-155m.san-bb1.cerf.net | 134.24.29.129 |
| 10 | sdsc-gw.san-bb1.cerf.net | 134.24.12.2 |
| 11 | bigmama.ucsd.edu | 192.12.207.5 |
| 12 | muir-rs-backbone.ucsd.edu | 132.239.254.11 |
| 13 | infopath.ucsd.edu | 132.239.50.184 |

In one embodiment, the latitude and longitude of the machines of the intermediate hops in the communication path may be considered in determining eligibility to participate in a skill game.

In another embodiment, the web site (residing on a machine or at an internet service provider) that hosts the skill game is connected to the main site of the operator of the skill game by a communication path, each part of which is known to lie within the jurisdiction in which skill games of the type being offered are legal.

There are numerous other skill games other than those based on providing responses to queries.

Figure 14:
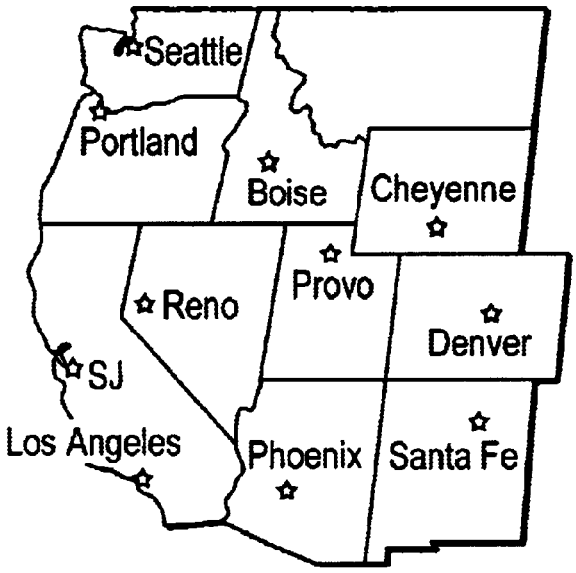
FIG. 14 shows the part of the information on the screen for playing one embodiment of a game involving creating a path of minimal total length connecting 12 cities.

The well-known mathematical traveling salesman problem can be used as the basis for a skill game. This game involves a map with a certain number of geographical locations. The geographical locations may be cities, tourist attractions, mountain peaks, intersections of streets in a city, or any other geographic feature. FIG. 14 shows the part of the information on the screen 1400 for playing one embodiment of a skill game with a map in which the geographic locations consist of 12 cities (Los Angeles, San Jose, Reno, Portland, Seattle, Boise, Helena, Cheyenne, Provo, Denver, Santa Fe, and Phoenix).

The goal of the skill game in FIG. 14 is to create a minimal-length itinerary (tour) that visits each geographical location once and only once (and returns to the starting location). For example, the player may start at any geographical location (say, Los Angeles). The player then chooses the second geographical location of the itinerary. This process continues until the player has chosen each of the geographical locations exactly one time each.

In one embodiment, the player provides his input by clicking on the first geographical location, then clicking on the second geographical location, and so forth, until the player has clicked on all geographical locations. In one embodiment of the traveling salesman game, as the player chooses each new geographical location (city), a line is automatically drawn, using processing logic, between the new city and the previous city as an aid to the player in visualizing the itinerary that he is creating. In one embodiment, the total mileage of the player's existing partial itinerary is computed, using processing logic, and displayed to the player as an additional aid in playing the game. If a player clicks on a city that is already included in his partial itinerary, the player is informed that that choice is not allowed (by a visual or auditory signal, or both). When the player completes his proposed solution, he clicks on button 1420 in FIG. 14 entitled "Click here to submit your answer".

In one embodiment, a button 1415 in FIG. 14 is provided to enable the player to delete the previous segment of a tentative itinerary. This button may be repeatedly applied to delete additional previous segments of the tentative itinerary. In one embodiment, button 1418 in FIG. 14 is provided to enable the player to delete his entire tentative itinerary and start over.

In another embodiment, the player enters a number next to the name of each geographical location to indicate the order of visiting the geographical locations. In the case of the map of FIG. 14, the player would enter a number between 1 and 12 next to each city's name, with each number being used exactly one time.

Suppose the player chooses Los Angeles as his starting city, the player's chosen second city is Denver, and the player's chosen third city is Phoenix. FIG. 15 shows a 12-city itinerary of which Los Angeles, Denver, and Phoenix are visited first. The itinerary shown in FIG. 15 is a very poor itinerary. For example, it clearly would have been better to have traveled from Los Angeles to Phoenix to Denver rather than from Los Angeles to Denver to Phoenix. FIG. 15 contains several other non-optimal sub-tours.

By employing one's own skill and judgment, one can quickly develop an itinerary that is superior to that of FIG. 15. An individual expending even more effort can develop an even better itinerary. The determination of the very best itinerary is not obvious. In general, the discovery of the optimal itinerary for the traveling salesman problem entails considerable skill.

In a traveling salesman problem involving even a modest number of cities, the number of distinct itineraries is larger than that which can be evaluated mechanically on a computer in any reasonable amount of time (e.g., in relation to the limited amount of time that the player is given to play the skill game). Specifically, the number of different permutations of N cities is N! (i.e., N factorial). Since the starting city and the order of traversal do not matter, the number of distinct itineraries is the number of different permutations divided by both N and 2, namely $(N-1)!/2$. As an example, for only 15 cities there are about 654 billion distinct itineraries.

In one embodiment, it is possible to click on each geographical location and bring up a small informational window indicating the distance (mileage) from each geographic location to each of the other geographical locations. In another embodiment, this distance information is provided in the familiar format of a two-dimensional mileage table, where each entry in the table is the distance between two geographic locations. In another embodiment, only the visual image of the map and geographical locations are provided.

The award criterion for this traveling salesman game may be attainment of an itinerary that is known to be optimal, attainment of at least a previously calculated near-optimal itinerary, or attainment of an itinerary that is better than that submitted by any other player.

In one alternative (applicable to this game and other skill games described below), the award criteria involves awarding one prize for correctly achieving a specified level of performance and at least one different (typically lesser) prize for achieving a specified lesser level of performance. In yet another embodiment, the award criteria additionally favors the speed of the player is submitting his response to the challenge presented by the game, thereby combining two kinds of skill. Thus, for example, if more than two players achieve the same specified level of performance, the player who first submits his response would be preferred over a slower player who also achieves the same level of performance. In another embodiment, one prize entitles the player to make a play of another skill game offered by the operator of the site.

In one embodiment (as shown by FIG. 14 and FIG. 15), the distance between the geographic locations is measured as the crow flies (that is, by Euclidean distance), as measured on either a flat surface or a spherical surface. However, in an alternative embodiment, the map includes routes (e.g., in the form of highways or streets) connecting the various geographic locations. In that embodiment, the itinerary must be along the routes shown and the distance is measured along the routes shown (as opposed to the distance as the crow flies). In one embodiment, the highways or streets are actual highways and streets of actual geographic areas.

Another example of a skill game is based on the well-known idea of a jigsaw puzzle. In such a game, there are a certain number of given pieces. The pieces are, in general, of different size and shape. If the given pieces are assembled correctly, they form a contiguous composition employing all of the pieces, such that the composition contains no gaps between any of the pieces.

Figure 16:
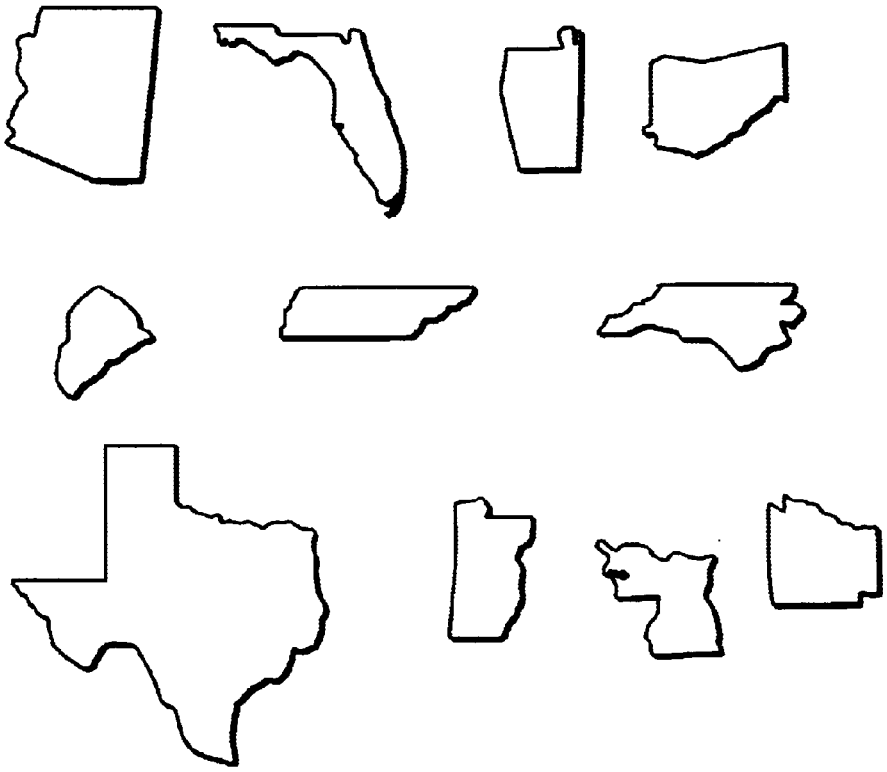
FIG. 16 shows the part of the information on the screen for playing one embodiment of a jigsaw puzzle game.

FIG. 16 shows the part of the information on the screen 1600 for playing one embodiment of a skill game based on a jigsaw puzzle with 11 pieces. In the game, the player is presented with the 11 disconnected pieces 1610.

Figure 17:
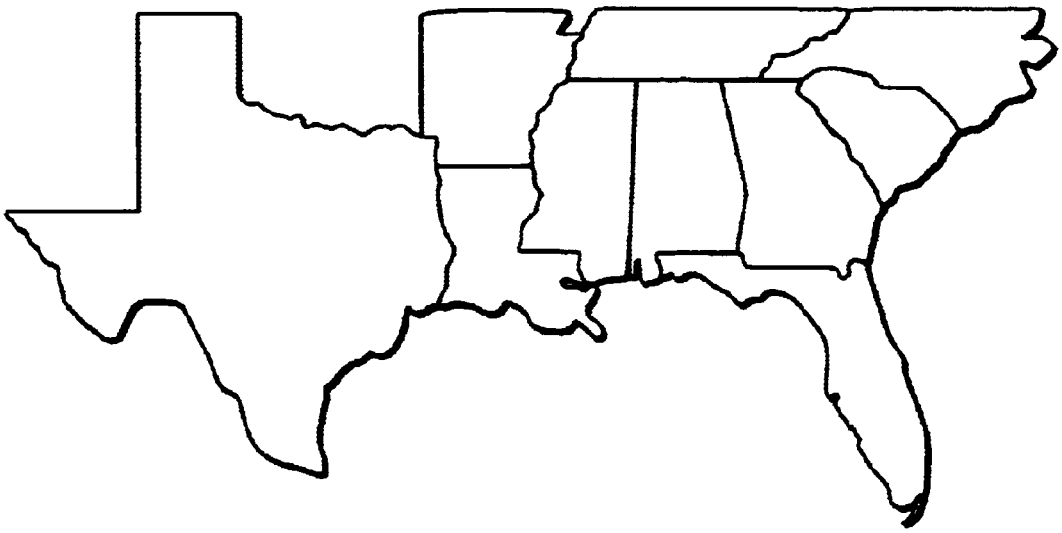
FIG. 17 shows a solution to the jigsaw puzzle game of FIG. 16.

FIG. 17 shows a solution to jigsaw puzzle game of FIG. 16, namely an arrangement in which the 11 southern states are contiguously arranged (with no gaps) so as to form a map. By comparing FIG. 16 with FIG. 17, the 11 pieces are not originally presented to the player in the orientation that they are needed in the correct final composition. Several of the states in FIG. 16 are rotated by various amounts (e.g., 90, 180, or 270 degrees) from their correct orientation. In one embodiment, pieces may be rotated by any angle. In one embodiment, the player provides his proposed solution by using a mouse pointer to move and rotate the given pieces. The player submits his entry by clicking on button 1620 in FIG. 16 entitled "Click here to submit your answer".

The award criterion for this jigsaw puzzle game may be attainment of a previously calculated perfect solution, attainment of a partial solution that employs a certain number of contiguous pieces, or attainment of a partial solution that employs more contiguous pieces than any entry submitted by any other player.

In one embodiment, at least some of the pieces may be originally presented to the player upside down. In this embodiment, the player is also capable of flipping the given pieces. All the boundaries of all the pieces may be straight lines. Also, in one embodiment, all of the pieces are of uniform coloration. In an alternative embodiment, the pieces bear a portion of an overall image. These portions of the overall image on the individual pieces serve as clues to the player in assembling the overall image. The overall image becomes apparent when all of the pieces are assembled into the correct final composition.

In the example of FIGS. 16 and 17, no outer boundary was indicated to the player. In one embodiment, the composition is constrained to a prespecified outer boundary and all the pieces must fit inside this boundary.

In addition, the well-known mathematical problem of discovering Hamiltonian paths can be used as the basis for yet another skill game. This game involves a graph consisting of a certain number of points (nodes) and various directed (one-way) lines connecting various pairs of points. Given any two points, there may be no line connecting the two points; there may be a one-way line going from the first point to the second point; there may be a one-way line going from the second point to the first point; or there may be two lines (one in each direction) connecting the two points. There is a designated starting point and a designated ending point. In one embodiment, this problem can be presented in the form of a map in which cities correspond to the points (nodes of the graph) and in which lines (with an arrow at one end) correspond to directed (one-way) lines. In one embodiment, the directed lines may be visualized as available airline flights going from one particular city to another city. The goal of the skill game is to create an itinerary (tour) that starts at the designated starting city, ends at the designated ending city, and that visits each other city once and only once, with each segment of the itinerary being in a permissible direction.

FIG. 18 shows the part of the information on the screen 1800 for playing a skill game based on this Hamiltonian path problem involving seven cities. In the map 1810 depicting the game, the starting city is Chicago 1801 and the ending city is New York 1807. The intermediate cities are Albany 1802, Washington 1803, Detroit 1804, Toronto 1805, and Dover 1806. There is a Hamiltonian path from starting city Chicago 1801 to ending city New York 1807 consisting of the following six directed (one-way) segments: segment 1831 from Chicago to Albany, segment 1832 from Albany to Washington, segment 1833 from Washington to Detroit, segment 1834 from Detroit to Toronto, segment 1835 from Toronto to Dover, and segment 1836 from Dover to New York 1807.

In one embodiment, a player indicates his choices by clicking on a directed (one-way) line leaving the designated starting city, then clicking on a directed line leaving the second city, then continuing in the same manner until the itinerary reaches the designated ending city, with each city being visited once and only once.

In one embodiment of the Hamiltonian path game, as the player clicks on successive directed line segments, the player is visually presented, using processing logic, with a count of the number of lines that he has clicked so far. The count is at zero at the beginning of the game and reaches N−1 (where N is the number of cities) if and when a satisfactory complete Hamiltonian path is discovered. In one embodiment, certain lines are highlighted as a visual aid to the player. For example, if the player first clicked on the line connecting starting city Chicago 1801 (FIG. 18) with Detroit 1804, the two outgoing directed line segments from Detroit 1804, namely the directed line segment from Detroit 1804 to Washington 1803 and the directed line segment from Detroit 1804 to Toronto 1805 are highlighted. The player is thus presented with the two alternatives that he has for leaving Detroit 1804. In one embodiment, a player need not begin at the starting city, but may instead work backwards from the ending city or work forwards or backwards from any directed line segment on the map. In one embodiment, when the player starts by first clicking on a line going into the ending city, the incoming directed line segments to the other end of that line are highlighted (as opposed to highlighting the outgoing directed line segments, as was the case when the player starts by first clicking on a line coming out of the starting city). In one embodiment, when the player starts by first clicking on a line that is not connected to either the starting city or the ending city, the directed line segments going out from the end of that line and the directed line segments coming in to the beginning of that line are highlighted as a visual aid to the player. The player submits his entry by clicking on button 1820 in FIG. 18 entitled "Click here to submit your answer".

In one embodiment, button 1815 in FIG. 18 is provided to enable the player to delete the previous lines of a tentative itinerary. This button may be repeatedly applied to delete additional previous lines of the tentative itinerary. In one embodiment, button 1818 in FIG. 18 is provided to enable the player to delete his entire tentative itinerary and start over.

The award criterion for this Hamiltonian path game may be attainment of a previously calculated complete itinerary, attainment of a partial itinerary that visits a certain number of the cities, or attainment of an itinerary that visits more cities than any other player.

The discovery of a satisfactory itinerary is not obvious. Although a Hamiltonian path problem with seven cities (as shown in FIG. 18) may be relatively easy to solve, the problem becomes very difficult for larger numbers of objects. In general, the discovery of a satisfactory itinerary entails considerable skill. In a Hamiltonian path problem involving even a modest number of cities, the number of distinct itineraries is larger than that which can be evaluated mechanically on a computer in any reasonable amount of time (i.e., in relation to the limited amount of time that the player is given to play the skill game).

The Hamiltonian path problem differs from the previously described traveling salesman problem in that the player sequentially chooses directed lines in the Hamiltonian path problem, but sequentially chooses geographical locations (cities) in the traveling salesman problem. In addition, the Hamiltonian path problem differs from the previously described traveling salesman problem in that distances play no role in the Hamiltonian path problem.

Both the Hamiltonian path problem and the traveling salesman problem are examples of combinatorial optimization problems of the type that are considered, in general, to be difficult to solve (Garey and Johnson 1979).

The well-known bin packing problem can be used as the basis for yet another skill game. The bin packing problem involves a two-dimensional region (called the "bin") and a collection of two-dimensional objects. Each of the objects has a particular size and shape. The goal is to insert objects into the bin so as to maximize the percentage of the surface area of the bin that is occupied by the inserted objects. An object may be inserted at most one time into the bin; however, it is possible that the set of objects at the beginning of the game may include multiple copies of a particular object.

In one embodiment, some or all of the objects are rectangles. In alternative embodiments, the objects are polygonal shaped or irregularly shaped.

In one embodiment, the bin is a single rectangle. In alternative embodiments, the bin is polygonal shaped or irregularly shaped. In another embodiment, the bin consists of two or more distinct sub-regions (e.g., two rectangles).

The discovery of an optimal packing configuration is unobvious. The percentage of the surface area of the bin that can be occupied (even with an optimal packing configuration) is usually much smaller than a person would initially estimate. It is not necessarily true that the highest percentage is achieved by inserting the greatest number of objects.

FIG. 19 shows the part of the information on the screen 1900 for playing a skill game based on the bin packing problem. In the particular instance of the bin packing problem shown, there are seven polygonal objects, including two rectangles (1911 and 1917) and five polygonal objects (1912, 1913, 1914, 1915, and 1916). The object of the game is to insert some or all of the seven objects into the bin 1905 so as to maximize the percentage of the surface area of the bin 1905 that is occupied by the inserted objects.

The game starts with none of the objects inside the bin (as shown in FIG. 19). In one embodiment, a player selects an object (by clicking on it) and then drags it to the particular location in the bin where he desires to insert it. The player also the ability to rotate the object as he is moving and inserting it into the bin. If an object cannot be inserted in a particular place (e.g., because it does not fit, because it is not entirely inside the bin, or because it overlaps with an already inserted object), the player receives, by means of processing logic, an error indication (which can be visual, auditory, or both). After the player successfully inserts an object into the bin, the percentage of the surface area of the bin that is currently occupied by inserted objects is computed, by processing logic, and is visually shown to the player (at 1908 in FIG. 19). The player can select, rotate, and drag objects that are currently either outside the bin (i.e., in their original starting location, as shown in FIG. 19) or that are already inside the bin. The player may remove an object from the bin in the process of trying to find the best solution. If the player removes an object from the bin, the percentage of the surface area of the bin that is then occupied by inserted objects is recomputed, by processing logic, and is visually shown to the player (at 1908 in FIG. 19). When the player completes his packing configuration, he clicks on button 1920 entitled "Submit" in FIG. 19.

In one embodiment, button 1918 in FIG. 19 is provided to conveniently enable the player to delete his entire current packing configuration and start anew.

The award criterion for this bin-packing game may be attainment of at least a previously calculated packing configuration that is known to be optimal, attainment of at least a previously calculated near-optimal packing configuration, or attainment of a packing configuration that is better than that submitted by any other player.

Although a bin packing problem with seven objects (as shown in FIG. 19) may be relatively easy to solve, the problem becomes very difficult for larger numbers of objects. In a bin packing problem involving even a modest number of objects, the number of distinct packing configurations is larger than that which can be evaluated mechanically on a computer in any reasonable amount of time (i.e., in relation to the limited amount of time that the player is given to play the skill game). The bin packing problem, like the Hamiltonian path problem and the traveling salesman problem, is an example of an vexatious combinatorial optimization problem (Garey and Johnson 1979).

The knapsack problem can also be used as the basis for yet another skill game. The knapsack problem involves a knapsack and a collection of objects (sometimes called "rocks"). Each of the objects has a particular weight and a particular value. For example, a piece of diamond may be light, but very valuable whereas a piece of granite may be heavy, but not very valuable. The goal is to insert objects into the knapsack so as to maximize the total value of all the objects in the knapsack, subject to the constraint that the total weight of the inserted objects does not exceed a certain preestablished maximum weight.

FIG. 22 shows the part of the information on the screen 2200 for playing a skill game based on the knapsack problem. In the particular instance of the knapsack problem shown, there are six given objects. The six objects are labeled 2211 through 2216 in FIG. 22. The object of the game is to insert some or all of the given objects into the knapsack 2205 so as to maximize the total value of the objects in the knapsack, provided that the total weight of the inserted objects does not exceed the preestablished maximum weight (maximum allowed weight indication 2206). For example, object 2211 weights 10 pounds and is worth $10 and the preestablished maximum weight 2206 for this instance of the knapsack game is 10 pounds.

The game starts with none of the six objects (2211 through 2216) inside the knapsack 2205. At the start of the game, the total weight of the objects currently in the knapsack is zero. Likewise, the total value of the objects currently in the knapsack is zero. In one embodiment, a player selects an object (by clicking on it) and then drags it into the knapsack. In contrast to the bin packing game, the size and shape of the objects are irrelevant to the play of this game. In contrast to the jigsaw game and the bin packing game, the exact placement in the knapsack and the exact relative location of the objects in the knapsack is not relevant to the play of this game. The relevant factors in the knapsack game are the weight and value of the objects that are inserted into the knapsack. If the attempted insertion of an object would cause the weight of the knapsack to exceed the preestablished maximum weight indication 2206, the player receives, by the use of processing logic, an error indication (which can be visual, auditory, or both). After the player successfully inserts an object into the knapsack 2205, the total weight of the objects currently in the knapsack is computed, by processing logic, and is visually shown to the player (total weight indication 2208 in FIG. 22). Also, the total value of the objects currently in the knapsack is computed, by processing logic, and is visually shown to the player (total value indication 2209 in FIG. 22). The player may remove any object from the knapsack in an attempt to find the best solution (by clicking on it and dragging it out of the knapsack, in one embodiment). When the player removes an object from the knapsack, the total weight and the total value of the objects currently in the knapsack is recomputed, by processing logic, and is visually shown to the player (using indications 2208 and 2209). A particular object may be inserted at most one time into the knapsack; however, it is possible that the set of objects at the beginning of the game may include duplicates of a particular object. When the player completes his entry, he clicks on "submit" button 2220.

In one embodiment, button 2218 in FIG. 22 is provided to conveniently enable the player to remove all objects currently in the knapsack and start anew.

The award criterion for this knapsack game may be attainment of a previously calculated total value for the objects that is known to be optimal, attainment of at least a previously calculated near-optimal total value for the objects, or attainment of a total value for the objects that is better than that submitted by any other player. In one embodiment, the objects are arranged so that the prize equals the value of the objects in winner's knapsack.

The discovery of an optimal set of objects to be inserted into the knapsack is, in general, unobvious and requires skill in numerical judgment and manipulation. Although a knapsack problem with six objects (as shown in FIG. 22) may be relatively easy to solve, the problem becomes very difficult for larger numbers of objects. In the knapsack problem, the number of possible ways of inserting objects in to the knapsack (without exceeding the maximum weight) is larger than that which can be evaluated mechanically on a computer in any reasonable amount of time (particularly in relation to the limited amount of time that the player is given to play the skill game).

To reiterate, the processing logic discussed herein may comprise hardware, software or a combination of both.

In one embodiment, the skill game is a video game based in which the player may take a series of actions at various times and accumulate a score based on the skillfulness of his chosen actions. In one particular embodiment, the video game is pinball. In the game of pinball, the player is in control of a limited number of control mechanisms (e.g., releasing a new ball and moving the flippers). A game such as pinball may be implemented as a computer game in which the game is entirely deterministic (i.e., contains no random or chance events). For example, the player selects the tension for releasing the ball. Once the player selects a particular tension, the ball starts moving in accordance with entirely deterministic equations of motion. As the ball moves across the playing field, entirely deterministic equations of motion determine the next state of the ball (e.g., its position and velocity). Similarly, as the ball hits various objects in the playing field, additional entirely deterministic equations of motion determine the next state of the ball in accordance with the characteristics of the object (e.g., the ball bounces off rubbery objects differently than solid surfaces). The player additionally has control of the flippers (and possibly additional control mechanisms). As the ball interacts with a flipper, additional entirely deterministic equations of motion determine the next state of the ball in accordance with the exact force applied to the ball by the flipper at the moment of impact. Thus, if the player's inputs to the control mechanisms were exactly identical on multiple plays of the game, the trajectory of the ball (and the total score accumulated during the play of the game) would be identical. A more skillful player of the game will accumulate a larger total score. Chance plays no role in the total score that is accumulated. Such an entirely deterministic version of the game pinball is a game of pure skill.

For a skill game that ends after a specified amount of time, the player may acquire the official time governing the game (as maintained by the operator) by clicking on an icon.

It should be noted that the date and time maintained by the time-keeping mechanism on the player's computer may differ from the official date and time at the operator's site. This discrepancy typically amounts to many seconds or a minute or so. However, this discrepancy may be large (e.g., the time-keeping mechanism on the player's computer may not be correctly considering daylight savings time and therefore be incorrect by an hour).

In one embodiment, an alarm clock application can be downloaded into the player's computer. Such alarm clock application is based on the time-keeping clock in the player's computer. In one embodiment, the alarm clock application displays the official time when the game started (as provided by the operator of the skill game at the time of downloading), the official time when the game is to end (as provided by the operator of the skill game at the time of downloading), the time on the player's computer when the alarm clock application started (obtained from the player's computer at the time of downloading), the current time according to the player's computer (obtained from the player's computer by repeated interrogation of the clock on the player's computer), and the time remaining to play. The alarm clock application executes on the player's computer. It reports the current time and the time remaining (both according to the clock mechanism of the player's computer). The time remaining is computed by taking the difference between the current time (from the player's computer) and the time when the alarm clock application started (obtained from the player's computer at the time of downloading). The alarm clock application can present a visual alert on the player's screen (and an audio alert, if an audio facility is available on the player's computer) when the time (according to the player's computer) is within a specified amount of time (e.g., one minute) of the end of the game. Because of the potential for slight discrepancies between the time mechanism on the player's computer and the official time maintained by the operator, the interval for the alarm should be considerable (e.g., one minute). The rules of each skill game specify that the official time as maintained by the operator of the site governs the game.

If the award criteria of a particular game includes the speed of the player's response, a time measuring application is, in one embodiment, downloaded onto the player's computer along with the skill game. This time measuring application executes on the player's computer and records the time on the player's computer of when the time measuring application starts (obtained by accessing the time-keeping mechanism on the player's computer at the time of downloading) and the time when the player submits his response to the operator of the skill game (obtained by accessing the time-keeping mechanism on the player's computer at the time of submission). The time measuring application reports these two times to the operator of the skill game at the time of submission. In one embodiment, this information is encrypted by the time-measuring application on the player's computer prior to transmission to the operator of the skill game and then decrypted by the operator of the skill game upon receipt at the operator's site. In one embodiment, the operator of the skill game calculates the difference in the two times recorded and reported by the time-measuring application to determine the speed of the player's response. In an alternative embodiment, the operator of the skill game uses the actual time of arrival of the player's submission at the operator's site in determining the speed of the player's response. In yet another embodiment, the operator defers to the difference in the two times recorded and reported by the time-measuring application provided that it is close to the difference as recorded at the operator's site. The rules of each skill game specify which of these alternative approaches is used on a particular skill game.

Optimal operation of the site of the skill game requires that the operator of the site balance several competing considerations. These considerations include, but are not limited to, the following.

First, it is desirable to offer potential players a wide choice of skill games and, in particular, a wide choice of distinctly different types of skill games. Some players may prefer skill games involving word skill; others may prefer manipulative games involving visualization skills (such as the jigsaw puzzle game of FIGS. 16 and 17); and yet others may prefer skill games involving some numerical skills (such as the knapsack game of FIG. 22). Among potential players preferring word games, some may prefer a skill game such as the president's game (FIGS. 3A and 3B) involving historical knowledge; others may prefer the format of a crossword puzzle (FIGS. 6 and 7); and yet others may prefer a letter reallocation game involving word skills (FIGS. 8 and 9).

Second, it is desirable that a player desiring to play a particular skill game be able to start playing the game as soon as possible. Generally, a single instance of a skill game is presented to multiple players. Moreover, in one embodiment described previously herein, all players receive the skill game at the same time. Thus, a player's participation does not begin until the simultaneous beginning of the skill game for all players of that particular instance of the skill game. Therefore, to the extent that players are provided with a wide choice of skill games and to the extent that multiple players play each skill game, these first two considerations conflict with one another.

Third, the number of players participating in a particular skill game affects the size of the prize that may be prudently offered by the operator for winning that particular skill game. Broadly speaking, a larger prize is associated with a greater number of players playing a particular skill game (or instance thereof). However, offering multiple distinctly different skill games, with each game starting as quickly as possible, divides the number of potential players available to play any particular skill game at any particular time. Thus, this consideration is in contention with both the goal of offering a wide variety of skill games and the goal of starting each game with as small a delay as possible.

Fourth, although the number of winners in a skill game cannot be precisely computed using mathematical principles (as is the case, for example, in a game of chance, such as roulette), the operator's estimate of the number of winners in a particular skill game is, in general, more uncertain if fewer players are playing a particular skill game (or instance thereof).

In one embodiment, a new instance of a skill game is offered to players as soon as a threshold number of players request the game. In one embodiment, this threshold is relatively low (perhaps as low as two). A low threshold maximizes the goals of offering a wide variety of skill games and the goal of starting each game with as small a delay as possible. If the operator of the site has previously computed accurate estimates of the likely number of winners of each instance of each skill game, the prize that is offered for winning may be larger than that first suggested by the low threshold number of players needed to launch the game. Thus, the first three considerations can be attained to some degree at the expense of the fourth.

In one embodiment, after the player successfully logs on to his account, the player is presented with a menu offering a choice of skill games.

FIG. 23 shows an illustrative menu 2300 for four skill games, namely the First Name Game (described previously in connection with FIG. 13), the Crossword Geography game (described previously in connection with FIGS. 6 and 7), the Bin Packing game (described previously in connection with FIG. 19), and the Traveling Salesman game (described previously in connection with FIGS. 14 and 15). The menu includes, in one embodiment, such characteristics as the name of the skill game 2320 (FIG. 23), the price for playing the skill game 2330, the prize available for winning 2340, the duration of the skill game 2370, and the number of previous winners 2380.

In one embodiment, if the player clicks on "Rules" (FIG. 23) for any skill game, additional information is provided concerning how to play the game, the award criteria, and the detailed rules of the game. For example, if the player clicks on "Rules" 2351, additional information is provided concerning how to play the First Name game, the award criteria for the First Name game, and the detailed rules of the First Name game. If the player clicks on the clickable area labeled "Sample" (FIG. 23) for any game, a practice instance of the game is provided. For example, if the player clicks on "Sample" 2361, a practice instance of the First Name game is provided. If the player clicks on the number of previous winners, detailed information about the number of players and the number of winners of each possible prize level is provided. For example, if the player clicks on "1,234 winners" 2381, detailed information about the number of players and the number of winners of each possible prize level is provided for the First Name game.

In one embodiment, the menu also shows the number of potential players 2390 currently waiting to play the game and the minimum (threshold) number 2395 of players needed to launch the game. The presentation of the number of waiting players and the threshold is advantageous because it enables a player, if he so desires, to reduce the amount of time that the player will wait for the start of a game.

In one embodiment, the menu highlights visually any game for which the difference between the minimum number of players needed to launch a skill game and the number of players waiting to play the skill game is exactly one. This highlighting is advantageous because it enables a player, if he so desires, to instantly start playing a game. In one embodiment, this highlighting is accomplished by a flashing icon.

The menu also provides a mechanism (shown in the embodiment presented in FIG. 23 as boxes such as 2311, 2312, 2313, and 2314, but which may also be implemented, in another embodiment, as clickable symbols or clickable icons) for a player to indicate that he desires to play one or more games. For example, if the player desires to play the Traveling Salesman game, he would click on the box 2314 associated with that game. In the figure, one other player is already waiting to play the Traveling Salesman game (as shown at the point labeled 2394 in FIG. 23). If the minimum (threshold) number of players needed to launch the game is two players (as shown at the point labeled 2399 in FIG. 23), an instance of the Traveling Salesman game is launched and simultaneously provided to both the present player and the one waiting player. Both players then have 10 minutes to submit a solution to the Traveling Salesman game (as shown at 2374 of FIG. 23). The menu would then be updated, by processing logic, to reflect the fact the no players are currently waiting to play that game (at 2394).

If the player desires to play either the Crossword game or the Bin Packing game, he could click on boxes 2312 and 2313, respectively, in FIG. 23. In FIG. 23, no players are currently waiting to play those games (as shown by the points 2392 and 2393, respectively, in FIG. 23). Thus, a player expressing a willingness to play either of these two games will encounter some amount of delay before playing either of the game.

In one embodiment, the menu of the available games is presented in order of the number of additional players required to launch the game. For example, in this embodiment, the First Name game and the Traveling Salesman game would be presented first on the menu (because they each require only one additional player to launch the game) while the Crossword game and Bin Packing game would be presented later on the menu (because they each require two additional players to launch the game). This order of presentation makes it easier for a player to select games which will start sooner.

Two players is an advantageous minimum number of players for launching an instance of a skill game in terms of providing competition, minimizing the amount of time that a player is likely to wait for game(s) of his choice, and maximizing the number of different skill games that may be simultaneously offered to players by the operator of the skill games.

The ability of the operator of the skill games to satisfy the competing goals of offering reasonably sized prizes, reducing, or even minimizing, the amount of time that a player is likely to wait for a skill game of his choice, and increasing, or even maximizing, the number of different skill games that are simultaneously offered may be enhanced by arranging the available skill games into a hierarchy of skill games.

Such a hierarchical arrangement of skill games has at least two levels. There is at least one skill game at each level of the hierarchy. In the hierarchy, funds associated with a skill game at one level of the hierarchy contribute to at least one prize that is offered by at least one skill game at a higher level of the hierarchy. In one embodiment, the contributed funds are a designated portion of the consideration paid by players of a skill game at a lower level of the hierarchy. In an alternative embodiment, the contributed funds are based on the value of prizes that are not awarded in skill games from a lower level of the hierarchy (because no player satisfied the award criteria for a particular prize during the play of that skill game). Thus, as play proceeds on the skill games at the lower levels of the hierarchy, contributions of one or both types are made towards the prizes offered by the skill games at the higher levels.

FIG. 24 shows a menu 2400 containing seven skill games (each of which has been previously described herein). The menu includes information about each of the skill games. For example, for the first of the seven skill games shown in the menu of FIG. 24, the menu specifies that the name 2421 of the skill game is the Decades Game, the consideration 2431 for playing the game is $1, the prize 2441 available for winning is $2, the duration 2471 of the game is 5 minutes, the number 2479 of previous winners is 2,344, the number 2481 of potential players currently waiting to play the game is 1, and the minimum (threshold) number 2491 of players needed to launch the game is 3. The menu of FIG. 24 is similar to the menu of FIG. 23 in that it also provides access to the rules of the game and provides access to a sample game.

The seven skill games of FIG. 24 are arranged in an illustrative hierarchy of three levels. The first four skill games (namely the Decades Game 2421, the Presidents Game 2422, the Knapsack Game 2423, and the Hamiltonian Path Game 2424) are in the lowest level of the hierarchy. The fifth and sixth skill games (namely the Months Game 2425 and the Traveling Salesman Game 2426) are in the middle level of the hierarchy. The seventh skill game (namely the States Game 2427) is at the highest level of the hierarchy. For purposes of illustration in FIG. 24, the three levels of the hierarchy are visually divided (with the lowest level being labeled 2401, the middle level being labeled 2405, and the highest level being labeled 2407); however, in practice, the three levels need not be separated in this way.

The operation of the hierarchy of skill games can be understood from an example.

First, suppose the consideration (price) of the Decades Game 2421 (FIG. 24) on the lowest level of the hierarchy is $1 (at 2431), that there is only one prize level offered in the game, and that the single available prize is $2 (at 2441). Suppose that the minimum (threshold) number of players needed to launch the Decades Game 2421 is 3 (at 2491), that an instance of the game is actually launched with three players (so that the total revenue is $3), and that one player actually wins the available prize of $2. In this example, assume that 70 cents of the total revenue for playing this skill game at the lowest level of the hierarchy is then allocated as a contribution for a skill game at the middle level of the hierarchy (namely the Months Game 2425). In one embodiment, the allocation is made to a skill game in the middle level that is of the same general type (i.e., a word response game) as the game at the lowest level.

Second, suppose the price for the Presidents Game 2422 (FIG. 24) on the lowest level of the hierarchy is $2 (at 2432), that there is only one prize level in the game, and that the single available prize is $5 (at 2442). Suppose that the minimum number of players needed to launch the Presidents Game 2422 is 3 (at 2492), that an instance of the game is in fact launched with three players (so that the total revenue is $6), and that one player wins the prize of $5. Again, assume that 70 cents of the total revenue for playing this skill game is allocated as a contribution for a skill game of the same general type (i.e., a word response game) in the middle level of the hierarchy (namely the Months Game 2425).

Third, suppose that the same contribution of 70 cents is also made available by the Knapsack Game 2423 and the Hamiltonian Path Game 2424 as a contribution for a skill game of the same general type (i.e., a mathematical game), namely the Traveling Salesman Game 2426, in the middle level of the hierarchy.

Thus, in the above example, all four skill games at the lowest level of the hierarchy contribute 70 cents toward a game at the middle level of the hierarchy. The result of these contributions is, in one embodiment, that the prize available in the two skill games in the middle level of the hierarchy may be larger ($10 at 2445 and 2446 in FIG. 24) than the prizes available in the four skill games in the lowest level ($2 at 2441 and 2443 and $5 at 2442 and 2444).

In one embodiment, the funds that are contributed to a skill game at a higher level of the hierarchy are based on the value of prizes that are not awarded at a lower level of the hierarchy.

In one embodiment, when a skill game at a higher level of the hierarchy is launched, players of the contributing skill game at the lower level are given a free play. In one embodiment, the only players in the skill game at the higher level are the previous players from the lower level. In another embodiment, the previous players from the lower level join in with paying new players at the higher level. In yet another embodiment, only paying players participate in the skill game at the higher level.

When the time of launch of a game (in particular a game at a higher level of the hierarchy) is not imminent, it is advantageous for the operator of the skill games to announce the deferral of the start of the game. In one embodiment, this information is directly presented on the menu (e.g., as shown at 2485 of FIG. 24). In another embodiment, players are informed of the starting time of a future game by e-mail as soon as the starting time is known to the operator of the skill games. This approach is especially appropriate if the starting time of the future game occurs at a considerable time in the future so that minor differences in the time of actual receipt or actual opening of the e-mail message are not a major consideration. In both of the foregoing embodiments, the player may then visit the site of the skill games at the announced starting time in order to obtain the skill game.

In yet other embodiment, the skill game may be provided to eligible players by e-mail. This approach is especially appropriate if the skill game has a lengthy duration of play (e.g., 24 hours at 2477 of FIG. 24) so that minor differences in the time of actual receipt or actual opening of the e-mail message are not a major consideration.

It is advantageous to offer games offering a variety of different prize levels (e.g., $2 at 2441 and 2443, $5 at 2442 and 2444, and $10 at 2445 and 2446, and $25 at 2447 in FIG. 24). It is also advantageous to offer games of various lengths (e.g., 5 minutes at 2471, 10 minutes at 2475, and 24 hours at 2477). In addition, it is advantageous to offer games at different prices ($1 at 2431 and 2433 and $2 at 2432 and 2434). In one embodiment, the higher priced skill games are more difficult. In one embodiment, the higher priced skill games are have a greater duration. In one embodiment, the higher priced skill games offer higher prizes.

The specific numerical values used in the above example are for the purpose of illustrating one possible embodiment involving variations in price, duration, prize, and methods for distributing funds within the hierarchy. The present invention is not intended to be limited to these particular numerical values. Numerous alternative numerical values and combinations of numerical values are possible.

An Exemplary Network

Figure 20:
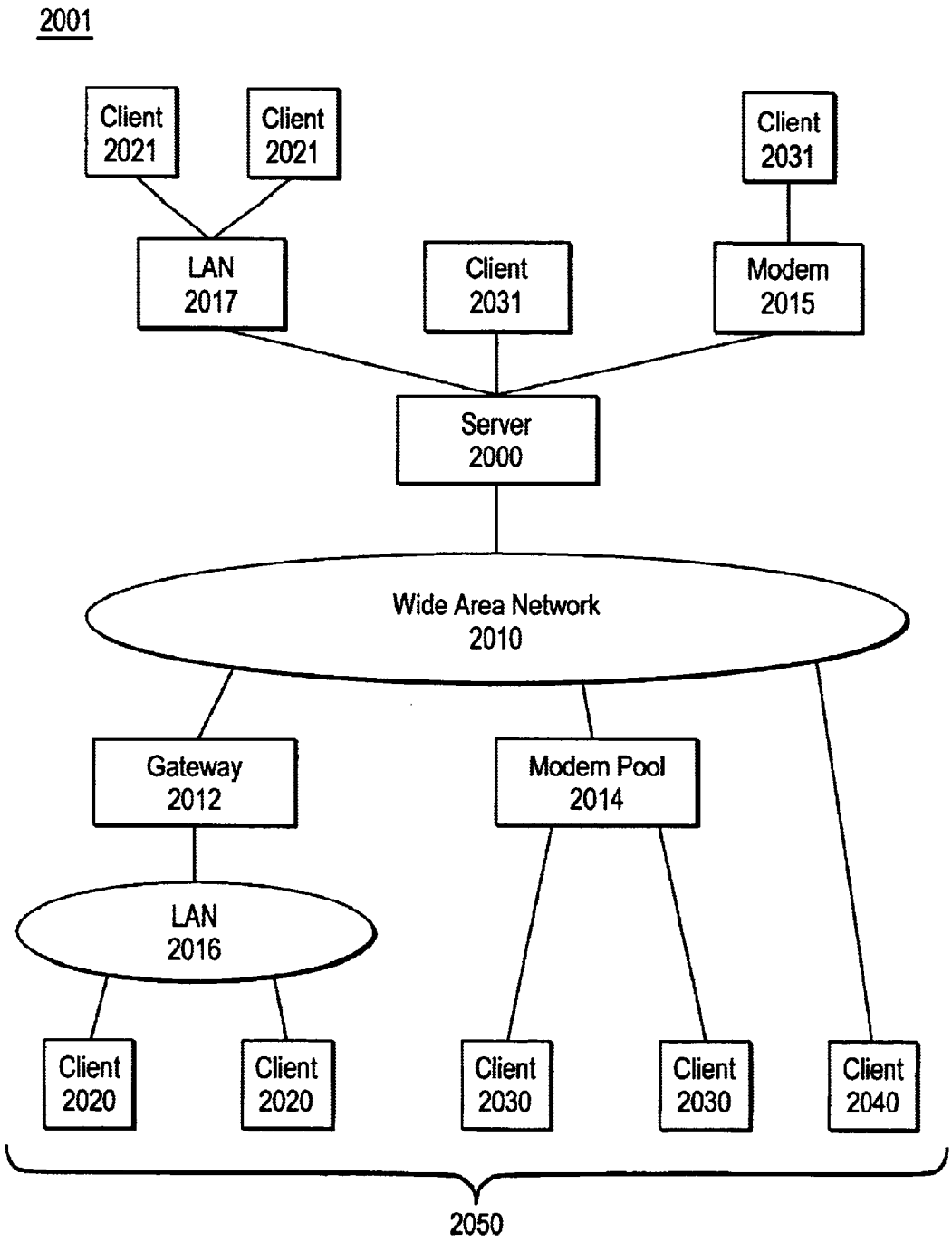
FIG. 20 is a block diagram of one embodiment of a network environment.

FIG. 20 is a block diagram of one embodiment of a network environment 2001 that may be used in the transmission technique described above. In one embodiment, a server computer system 2000 is coupled to a wide-area network 2010. Wide-area network 2010 may include the Internet or other proprietary networks including, but not limited to, America On-Line™, CompuServe™, Microsoft Network™, and Prodigy™. Wide-area network 2010 may include conventional network backbones, long-haul telephone lines, Internet and/or Intranet service providers, various levels of network routers, and other conventional mechanisms for routing data between computers. Using network protocols, server 2000 may communicate through wide-area network 2010 to client computer systems 2020, 2030, 2040, which are possibly connected through wide-area network 2010 in various ways or directly connected to server 2000. For example, client 2040 is connected directly to wide-area network 2010 through direct or dial-up telephone or other network transmission line.

Alternatively, clients 2030 may be connected through wide-area network 2010 using a modem pool 2014. Modem pool 2014 allows multiple client systems to connect with a smaller set of modems in modem pool 2014 for connection through wide-area network 2010. Clients 2031 may also be connected directly to server 2000 or be coupled to server through modem 2015. In another alternative network typology, wide-area network 2010 is connected to a gateway computer 2012. Gateway computer 2012 is used to route data to clients 2020 through a local area network 2016. In this manner, clients 2020 can communicate with each other through local area network (LAN) 2016 or with server 2000 through gateway 2012 and wide-area network 2010. Alternatively, LAN 2017 may be directly connected to server 2000 and clients 2021 may be connected through LAN 2017.

Using one of a variety of network connection mechanisms, server computer 2000 can communicate with client computers 2050. In one embodiment, a server computer 2000 may operate as a web server if the World-Wide Web ("WWW") portion of the Internet is used for wide area network 2010. Using the HTTP protocol and the HTML coding language, such a web server may communicate across the World-Wide Web with clients 2050. In this configuration, clients 2050 use a client application program known as a web browser such as the Netscape™ Navigator∩, the Internet Explorer™, the user interface of America On-Line™, or the web browser or HTML translator of any other conventional supplier. Using such browsers and the World Wide Web, clients 2050 may access graphical and textual data or video, audio, or tactile data provided by the web server 2000.

In one embodiment, server 2000 contains the exchange mechanism and the database storing Java content.

An Exemplary Computer System

Figure 21:
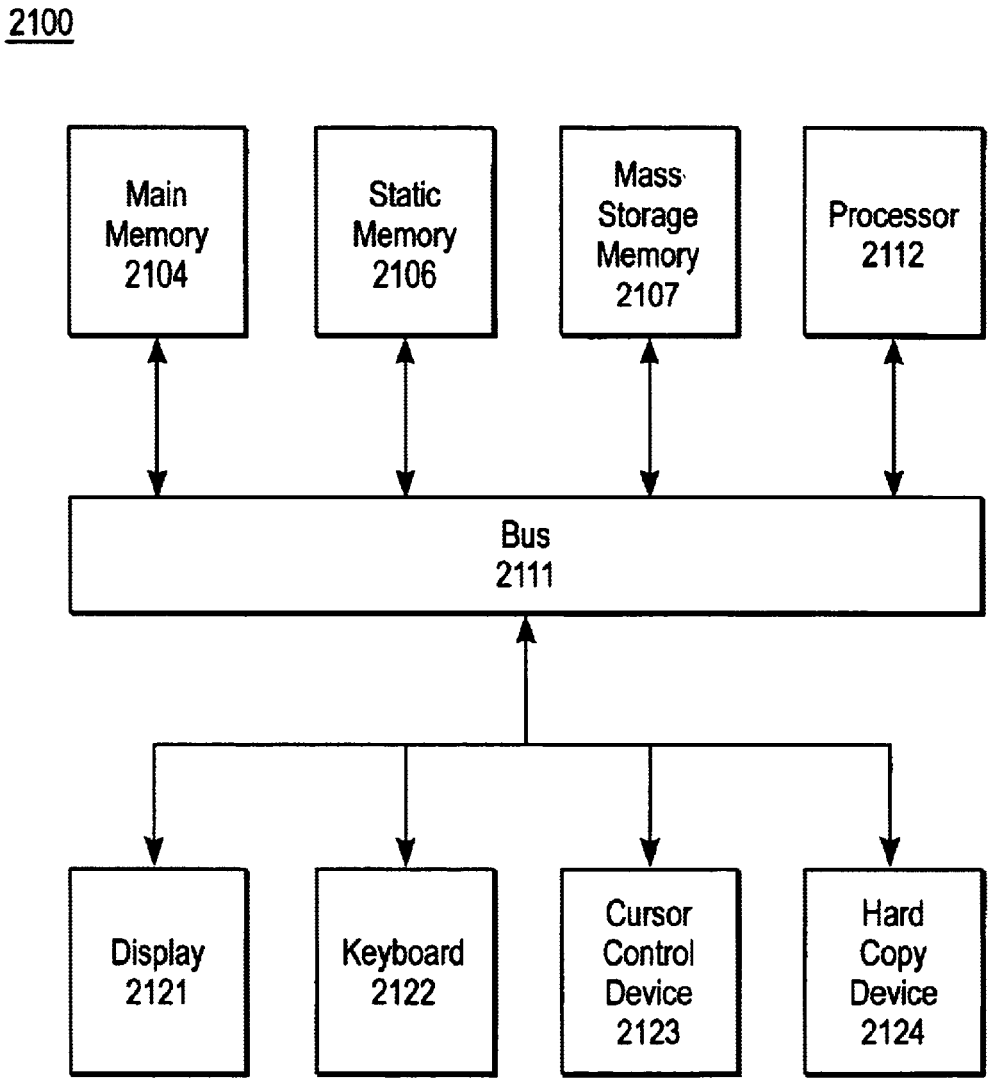
FIG. 21 is a block diagram of an exemplary computer system.

FIG. 21 is a block diagram of an exemplary computer system. Referring to FIG. 21, computer system 2100 may comprise an exemplary client 2050 or server 2000 computer system. Computer system 2100 comprises a communication mechanism or bus 2111 for communicating information, and a processor 2112 coupled with bus 2111 for processing information. Processor 2112 includes a microprocessor, but is not limited to a microprocessor, such as, for example, Pentium™, PowerPC™, Alpha™, etc.

System 2100 further comprises a random access memory (RAM), or other dynamic storage device 2104 (referred to as main memory) coupled to bus 2111 for storing information and instructions to be executed by processor 2112. Main memory 2104 also may be used for storing temporary variables or other intermediate information during execution of instructions by processor 2112. In one embodiment, main memory 2104 has a portion of its memory allocated to a ad database for storing Java content.

Computer system 2100 also comprises a read only memory (ROM) and/or other static storage device 2106 coupled to bus 2111 for storing static information and instructions for processor 2112, and a data storage device 2107, such as a magnetic disk or optical disk and its corresponding disk drive. Data storage device 2107 is coupled to bus 2111 for storing information and instructions.

Computer system 2100 may further be coupled to a display device 2121, such as a cathode ray tube (CRT) or liquid crystal display (LCD), coupled to bus 2111 for displaying information to a computer user. An alphanumeric input device 2122, including alphanumeric and other keys, may also be coupled to bus 2111 for communicating information and command selections to processor 2112. An additional user input device is cursor control 2123, such as a mouse, trackball, trackpad, stylus, or cursor direction keys, coupled to bus 2111 for communicating direction information and command selections to processor 2112, and for controlling cursor movement on display 2121.

Another device which may be coupled to bus 2111 is hard copy device 2124, which may be used for printing instructions, data, or other information on a medium such as paper, film, or similar types of media. Furthermore, a sound recording and playback device, such as a speaker and/or microphone may optionally be coupled to bus 2111 for audio interfacing with computer system 2100. Note that any or all of the components of system 2100 and associated hardware may be used in the present invention. However, it can be appreciated that other configurations of the computer system may include some or all of the devices.

Several variations in the implementation of the present invention have been described. The specific arrangements and methods described here are illustrative of the principles of this invention. Numerous modifications in form and detail may be made by those skilled in the art without departing from the true spirit and scope of the invention. Although this invention has been shown in relation to a particular embodiment, it should not be considered so limited. Rather it is limited only by the appended claims.

We claim:

1. A game comprising:

network communication means for enabling communication between a player of the skill game and an operator of the skill game;

identification means for determining whether a potential player of the skill game is legally eligible, by virtue of age and location, to participate, wherein the identification means includes means for accessing one or more databases to identify geographic locations of at least one server or internet service provider (ISP), including the ISP or server through which the potential player communicates to the operator of the skill game, to determine if the ISP or server is located in a legally eligible location and to determine if a type of the skill game is legally allowed by laws of a jurisdiction associated with the location;

means for preventing the player from participating in the skill game in response to the identification means determining the player is ineligible;

means for receiving consideration from the player to operator of the skill game in exchange for the opportunity to participate in the skill game;

means for providing the player with a game, using the network communication means; and award criteria means for determining whether the player receives a prize, the award criteria being based on skill.

2. The skill game defined in claim 1 wherein the skill game comprises a word game.

3. The skill game as defined in claim 1 wherein the award criteria comprises awarding a prize to a player correctly answering all the queries.

4. The skill game as defined in claim 1 wherein the award criteria comprises awarding a prize to a player correctly answering more queries than other player participating in the skill game.

5. The skill game as defined in claim 1 wherein the award criteria comprises awarding one prize for correctly answering a specified number of queries and at least one different prize for correctly answering a smaller number of the queries.

6. The skill game as defined in claim 1 wherein the award criteria comprises speed of the player in submitting responses.

7. The skill game as defined in claim 1 wherein the game comprises a video game in which the player takes at least one action and achieves a score based on the skill of the actions.

8. The skill game as defined in claim 7 wherein the game based on the theme of pinball.

9. The skill game as defined in claim 1 wherein the award criteria comprises awarding at least one prize entitling a player to an additional play of another skill game.

10. The skill game as defined in claim 1 wherein the award criteria comprises adding a designated portion of at least one prize that is not awarded during the play of the skill game to the prize available in another skill game.

11. The skill game as defined in claim 1 wherein the player provides the consideration to participate in the skill game using a credit card.

12. The skill game as defined in claim 1 wherein the player receives a prize via direct credit to a credit card account.

13. The skill game as defined in claim 1 wherein the player receives a prize via direct electronic transfer of funds to a bank account.

14. The skill game as defined in claim 1 wherein information about the player is retained and stored for comparison with future applications to participate in the skill game when the player is ineligible.

15. The skill game as defined in claim 1 wherein a geographic location of a telephone number given by the player is tested for consistency with the physical address given by the player, the comparison being used to ascertain eligibility to participate in the skill game.

16. The skill game as defined in claim 1 wherein a geographic location of a physical address given by the player is tested for consistency with the IP address of the point of origin of player communication, the comparison being used to ascertain eligibility to participate in the skill game.

17. The skill game as defined in claim 1 wherein a geographic location of a telephone number given by a potential player is tested for consistency with the IP address of the communication originating from the player, the comparison being used to ascertain eligibility to participate in the skill game.

18. The skill game as defined in claim 1 wherein caller identification is employed to ascertain a telephone number from which the player is calling the web site hosting such skill game site in order to determine that the player is located in a particular jurisdiction, the determination being used to ascertain eligibility to participate in the skill game.

19. The skill game as defined in claim 1 wherein a geographic location of each part of a communication path from the player to an operator of the skill game is determined.

20. The skill game as defined in claim 1 wherein a geographic location of each part of a communication path from the player to an operator of the skill game at least partially determines the eligibility to play the skill game.

21. The skill game as defined in claim 1 further comprising means for providing an alternative web site to the player, the alternative web site providing a communication path to an operator of the skill game, each part of the path being located within a particular known jurisdiction.

22. The skill game as defined in claim 1 wherein an application is downloaded to the player's computer that accesses the time-keeping mechanism of the player's computer and alerts the player as to the amount of time remaining to play a game.

23. The skill game defined in claim 1 wherein the identification means tests the address given by a potential player for consistency with an address associated with a financial account being used by the player for payment.

24. The skill game a defined in claim 1 wherein the identification means tests the age given by a the player for consistency with a birth date associated with a financial account being used by the player for payment.

25. The skill game defined in claim 1 wherein the game comprises a plurality of points, a plurality of directed lines connecting certain pairs of the points, one of the points being designated as the starting point, another of the points being designated as the ending point, and wherein a response of the player comprises specifying an itinerary comprising of an ordered set of directed lines that starts at the designated starting point, that ends at the designated ending point, that visits each other of the points once and only once, and such that each directed line in the itinerary connects one point in the itinerary to an immediately following point in the itinerary.

26. The skill game defined in claim 25 wherein the player defines the itinerary by sequentially clicking on each of the directed lines exactly one time each.

27. The skill game defined in claim 1 wherein the game comprises a plurality of two-dimensional objects and at least one two-dimensional region, and further wherein a response comprises inserting at least one of the objects inside a region, each inserted object being positioned by the player at a particular location and orientation inside the region, each inserted object being positioned by the player so as to not overlap with any other inserted object, in an attempt to maximize the percentage of surface area of the at least one region that is occupied by the inserted objects.

28. The skill game defined in claim 1 wherein the game comprises a plurality of objects, each object possessing both a value and a weight, and further wherein the player's response comprises choosing at least one object, in an attempt to maximize the total value of all chosen objects, subject to the constraint that the total weight of the chosen objects does not exceed a preestablished maximum weight.

29. The skill game as defined in claim 1 wherein an application is downloaded to the player's computer that accesses the time-keeping mechanism of the player's computer and records the time of the player's receipt of the game and the time of the player's submission of his response to the game and transmits the two times as part of the player's submission.

30. The skill game as defined in claim 1 wherein the game comprises a plurality of queries for which the player provides responses to the queries.

31. The skill game as defined in claim 30 wherein the queries are expressed in the form of direct questions.

32. The skill game as defined in claim 30 wherein the queries are expressed in the form of hints.

33. The skill game as defined in claim 30 wherein each response to the queries belong to an identified category, the category having a known limited number of elements.

34. The skill game as defined in claim 33 wherein the elements comprise names of presidents of the United States.

35. The skill game as defined in claim 33 wherein the elements comprise names of states.

36. The skill game as defined in claim 33 wherein the elements comprise names of the months of the year.

37. The skill game as defined in claim 33 wherein the elements comprise time periods of the year represented by the signs of the Zodiac.

38. The skill game as defined in claim 33 wherein the elements comprise time periods represented by ranges of years.

39. The skill game as defined in claim 33 wherein the elements comprise days of the month.

40. The skill game as defined in claim 33 wherein the elements comprise days of the week.

41. The skill game as defined in claim 33 wherein the player uses each response belonging to the identified category no more than once.

42. The skill game as defined in claim 33 wherein the player uses each response belonging to the identified category any number of times.

43. The skill game as defined in claim 33 wherein each of the responses to each of the queries belongs to an identified category.

44. The skill game as defined in claim 43 wherein the category is based on historical events.

45. The skill game as defined in claim 43 wherein the category is based on dates.

46. The skill game as defined in claim 43 wherein the category is based on geographic places.

47. The skill game as defined in claim 43 wherein the category is based on biographic figures.

48. The skill game as defined in claim 43 wherein the category is based on the names of entertainment personalities and their works.

49. The skill game as defined in claim 43 wherein the category is based on words.

50. The skill game as defined in claim 43 wherein the category is based on numbers.

51. The skill game as defined in claim 30 wherein a number of symbols in a correct response to a query is made known to the player.

52. The skill game as defined in claim 30 wherein a number of symbols in a correct response to a query is open-ended.

53. The skill game as defined in claim 30 wherein the player is provided with a visual arrangement in at least two dimensions of possible responses, the arrangement indicating the number of letters of the alphabet in each correct response and comprising at least one instance where a letter in a correct response to one of the queries lies in common with a letter in a correct response of another of the queries.

54. The skill game as defined in claim 53 wherein at least one correct letter is provided to the player as part of the visual presentation.

55. The skill game as defined in claim 53 wherein all the letters of one word in the visual arrangement are provided to the player, the one word suggesting the category to which all of other answers belong.

56. The skill game as defined in claim 53 wherein the visual arrangement is in three dimensions.

57. The skill game as defined in claim 30 wherein the player is presented with at least one starting word and wherein a correct response is a word composed of letters from the starting word.

58. The skill game defined in claim 30 wherein each of the responses to each of the queries is a first name, a list of a number of the first names being provided to the player as possible responses to the queries.

59. The skill game defined in claim 1 wherein the game comprises a map with a plurality of geographic locations in which a response of the player comprises specifying an itinerary for traveling to all of the geographic locations exactly once in an attempt to optimize one or more characteristics of the itinerary.

60. The skill game defined in claim 59 wherein one characteristic comprises the minimization of total distance traveled on the itinerary.

61. The skill game defined in claim 60 wherein the total distance between locations is measured using the Euclidean measurement of distance.

62. The skill game defined in claim 60 wherein the total distance between locations is measured along designated routes.

63. The skill game defined in claim 59 wherein the geographical locations are cities.

64. The skill game defined in claim 59 wherein the geographical locations are tourist attractions.

65. The skill game defined in claim 59 wherein the geographical locations are intersections.

66. The skill game defined in claim 59 wherein the player defines the itinerary by sequentially clicking on the geographic locations exactly one time each.

67. The skill game defined in claim 1 wherein the game comprises a plurality of pieces, the pieces being capable of assembly into a composition, the composition employing all of the pieces, the composition possessing no gaps between any of the pieces, and the composition possessing no overlapping pieces.

68. The skill game defined in claim 67 wherein the composition is constrained to a prespecified boundary into which all the pieces have to fit.

69. The skill game defined in claim 67 wherein all of the pieces are of uniform coloration.

70. The skill game defined in claim 67 wherein each of the pieces bears a portion of an overall image, the overall image becoming apparent when pieces are assembled into the composition.

71. Menu means for presenting a plurality of skill games as defined in claim 1, comprising information indicative of the likely starting time of each of the skill games and selection means by which a player offers to participate in at least one of the skill games.

72. Menu means as defined in claim 71 in which the indication is provided by the number of players waiting to play each of the skill games and the minimum number of players needed to launch each of the skill games.

73. The menu means as defined in claim 71 further comprising the number of previous winners of each of the skill games.

74. The menu means as defined in claim 71 wherein the available skill games are presented in order of the number of additional players required to launch the skill game.

75. The menu as defined in claim 71 further comprising an indication that the difference between the minimum number of players needed to launch a skill game and the number of players waiting to play the skill game is one.

76. A hierarchy of skill games, each of the skill games as defined in claim 1, wherein the hierarchy comprises at least two levels with at least one skill game at each level of the hierarchy, funds associated with a skill game at one level of the hierarchy contributing to at least one prize of at least one skill game at a higher level of the hierarchy.

77. The hierarchy of claim 76 wherein the funds comprise a portion of the consideration paid by players of a skill game at a lower level of the hierarchy.

78. The hierarchy of claim 76 wherein the funds are based on the value of prizes that were not awarded by a skill game at a lower level of the hierarchy.

79. The skill game of claim 76, wherein when a skill game at a higher level of the hierarchy is launched, players of the skill game at a lower level receive a free play.

80. The skill game defined in claim 1 wherein the identification means includes means for determining a telephone number that called the server or ISP and means for determining the geographic location of the potential player from the telephone number.

81. The skill game defined in claim 1 wherein the identification means further comprises means for determining a communication path of one or more hops from the potential player to the skill game operator and means for determining that location of the one or more hops are in legally eligible locations.

82. The skill game defined in claim 1, wherein the game has a plurality of control mechanisms available for selection to control play of the game and the play of the game occurs according to deterministic equations defining physical laws of nature.

83. The skill game defined in claim 82 wherein the deterministic equations comprise equations of motion.

84. The skill game defined in claim 82 wherein the game involves movement of one or more balls.

85. The skill game defined in claim 84 wherein the game comprises pinball.

86. The skill game as defined in claim 1 wherein the player responds to the skill game by speaking and further comprising speech recognition means to recognize the spoken responses.

* * * * *